US008180232B2

(12) United States Patent
Lawniczak et al.

(10) Patent No.: US 8,180,232 B2
(45) Date of Patent: May 15, 2012

(54) APPARATUS FOR MAKING COMBINATION PRINTS WITH PLEASING APPEARANCE

(75) Inventors: Gary P. Lawniczak, Rochester, NY (US); Donald S. Rimai, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 95 days.

(21) Appl. No.: 12/846,643

(22) Filed: Jul. 29, 2010

(65) Prior Publication Data

US 2012/0027440 A1 Feb. 2, 2012

(51) Int. Cl.
*G03G 15/01* (2006.01)
*G03G 15/00* (2006.01)

(52) U.S. Cl. ..... 399/40; 399/408

(58) Field of Classification Search ..... 399/40, 399/407–409

See application file for complete search history.

(56) References Cited

U.S. PATENT DOCUMENTS

| | | | | |
|---|---|---|---|---|
| 6,577,845 | B2 | 6/2003 | Stevens | |
| 7,419,151 | B2 | 9/2008 | Kaneko | |
| 7,627,271 | B2 | 12/2009 | Ookushi et al. | |
| 7,641,951 | B2 | 1/2010 | Hodsdon et al. | |
| 7,720,401 | B2 | 5/2010 | Domoto et al. | |
| 7,747,212 | B2 * | 6/2010 | Yamamoto | 399/408 |
| 8,081,329 | B2 * | 12/2011 | Lang et al. | 358/1.15 |

* cited by examiner

*Primary Examiner* — Hoang Ngo
(74) *Attorney, Agent, or Firm* — Roland R. Schindler, II

(57) ABSTRACT

Printers are provided. In one aspect, a printer has a printer controller cooperating with a print engine, receiver transport system, overlap positioning system, and fuser to cause a first toner image to be formed on the first side of the first receiver with toner at least in an overlap area proximate to a first edge of the first receiver; to overlap the first edge of the first receiver with a second edge of the second receiver having a second thickness at a second end and to fuse the overlapped first receiver and second receiver to cause the toner in the overlap area to bond the first receiver to the second receiver. The first toner image includes an edge concealment toner pattern positioned confronting the second edge with the edge concealment toner pattern having toner that reduces the visual impact of image artifacts created by the overlapping second edge.

24 Claims, 36 Drawing Sheets

APPARATUS FOR MAKING COMBINATION PRINTS WITH PLEASING APPEARANCE

CROSS REFERENCE TO RELATED APPLICATIONS

This application relates to commonly assigned, copending U.S. application Ser. No. 12/846,651, filed Jul. 29, 2010, entitled: "A METHOD FOR FORMING DURABLE COMBINATION PRINTS"; U.S. application Ser. No. 12/846,660, filed Jul. 29, 2010, entitled: "APPARATUS FOR FORMING DURABLE COMBINATION PRINTS"; U.S. application Ser. No. 12/846,634, filed Jul. 29, 2010, entitled: "A METHOD FOR MAKING COMBINATION PRINTS WITH PLEASING APPEARANCE"; U.S. application Ser. No. 12/846,623, filed Jul. 29, 2010, entitled: "A METHOD FOR FORMING A COMBINATION PRINT WITH CONTINUOUS IMAGING" and U.S. application Ser. No. 12/846,611, filed Jul. 29, 2010, entitled: 'OVERLAP POSITIONING SYSTEM" each hereby incorporated by reference.

FIELD OF THE INVENTION

This invention pertains to the field of printing.

BACKGROUND OF THE INVENTION

Sheet fed digital printers are capable of storing only limited numbers of different types of receivers. However, with increased use of digital image capture, image editing and digital image and document creation, there is an increased demand for prints that have specific print lengths that are not typically stored in such sheet fed printers.

This demand can be met by manually feeding such printers with receivers that have the specific print length. This adds significant costs to the process of printing using the requested receiver in that less frequently used receiver must be acquired and manually loaded before printing and because the manual loading process includes expenses for the labor required to locate and to load such receiver into the printer. It will be appreciated that such manual processes can also lead to delays in printing.

Alternatively, this demand can be met by cutting receiver to the specific receiver length. Typically, this is accomplished by printing on a stored receiver that is larger than the required print length and cutting excess length from the receiver during one or more finishing operations. Such finishing requires manual processes or the provision of equipment that is capable of cutting longer prints to the determined length. The use of either form of finishing can add significant equipment or processing costs and/or can add significant processing time to the fulfillment of the print order.

In still another alternative, print orders for prints that have specific print lengths that are not typically stored in such sheet fed printers. However, such an approach requires a custom measuring and cutting operations for each receiver. Printing and cutting long sheets poses several limitations. First, rolls of paper are heavy and hard to handle. The use of such roles precludes rapidly changing from one type of paper to another. Moreover, an entire print would have to be made from a single type of paper. Having a print engine and process capable of printing on sheets of paper that can be bound allows using different papers for special effects at different portions of the print. For example, a cover can be printed using a heavy black paper around the spine portion and a different color paper where the title and author are to be printed, thereby creating a decorative effect. Textured papers can also be blended with non-textured papers for an artistic effect.

Accordingly, what is needed is a method for printing and a printer that enable readily available stored receivers in a printer to be used to create prints that have specific lengths without requiring precutting or finishing operations.

What is also needed in the art is a method for operating a printer and a printer that can generate long prints using combinations of sections of available stored receivers in a printer.

One attempt to meet this second need in an electrophotographic printing system is described in U.S. Pat. No. 6,577,845 entitled "End to End Binding Using Imaging Material and Continuous Sheet Printing" issued to Stevens on Jun. 10, 2003. This patent describes using imaging material binding techniques to simulate continuous sheet printing with single sheets of printed receiver. In accordance with the methods described therein, imaging material is applied to a binding region along the trailing edge of a first printed sheet. The trailing edge of the first printed sheet and the leading edge of a following second sheet are overlapped and the imaging material is activated to bind the sheets together. This process may be repeated for successive sheets to form one continuous sheet. The technique described therein is said to be capable of implementation, for example, in a stand alone appliance used in conjunction with a conventional single sheet printer, as in integrated printing device or through a computer readable medium used to control operations in one or both of these devices.

FIGS. 1A, 1B and 1C show examples of the bound sheets created by the '845 patent adapted from FIGS. 13, 14 and 15 of that patent. These figures are said to show three different configurations for overlapping first, second and third sheets. As is described in the '845 patent, imaging material is applied to each sheet 2, 4 and 6 to form the desired print image 8, if any. In the configuration of FIG. 1A, imaging material is also applied for binding to the leading edge 10 of each following sheet 4, 2 which is lapped under the trailing edge 12 of each leading sheet 6, 4. In the configuration of FIG. 1B, imaging material is applied for binding to the trailing edge 12 of each leading sheet 6, 4 which is lapped under the leading edge 10 of each following sheet 4, 2. In the configuration of FIG. 1C imaging material is applied for binding to the leading and trailing edges 10 and 12 of the middle sheet 4 which is lapped under the trailing edge of the leading sheet 6 and the leading edge of the following sheet 2.

As will be observed from FIGS. 1A, 1B, and 1C, in each of the prints formed in accordance with the method shown in the '845 patent, there is a step S at every overlapping edge. Each step S has a step drop off height that is at least as tall as a thickness of the edge of the overlapping receiver and any toner image recorded thereon. Generally, speaking, the thickness of a paper type receiver can be between 81 um and 450 um depending on the weight of the paper. Further, in electrophotographic printers, a layer of toner is applied to the surface of such receiver, further increasing the thickness of the overlapping print by a range of between about 10 um and 50 um after fusing. While these ranges are provided by way of example only, it will be appreciated that a step having a height of at least about 100 um can be expected and that the step height may be substantially greater in many cases.

A step of such height detracts from the overall appearance of the printed image by providing a vertical or horizontal line extending across an image in which a difference in relief is observable from all angles of viewing, and in which an unprinted edge of the overlapping sheet is viewable from many angles of viewing. Both of these conditions detract from the appearance of a combined print. Such artifacts are typically not acceptable to consumers who expect prints to be recorded on a continuous receiver.

A step of such height also creates a catch point that can cause damage to the bound sheets if mechanically engaged while the combination print is being moved.

What is needed therefore are improved printing methods and systems that can join receivers to form a combination print having a length that is greater than a length of any available receiver but with a more durable configuration and a better appearance.

SUMMARY OF THE INVENTION

Printers are provided. In one aspect, a printer has a printer controller cooperating with a print engine, receiver transport system, overlap positioning system, and fuser to cause a first toner image to be formed on the first side of the first receiver with toner at least in an overlap area proximate to a first edge of the first receiver; to overlap the first edge of the first receiver with a second edge of the second receiver having a second thickness at a second end and to fuse the overlapped first receiver and second receiver to cause the toner in the overlap area to bond the first receiver to the second receiver. The first toner image includes an edge concealment toner pattern positioned confronting the second edge with the edge concealment toner pattern having toner that reduces the visual impact of image artifacts created by the overlapping second edge.

BRIEF DESCRIPTION OF THE DRAWINGS

FIGS. 9 and 10 illustrate the thickness of toner at first end of toner edge shield being built up in part by including amount of toner from overlap area.

DETAILED DESCRIPTION OF THE INVENTION

Figure 2:
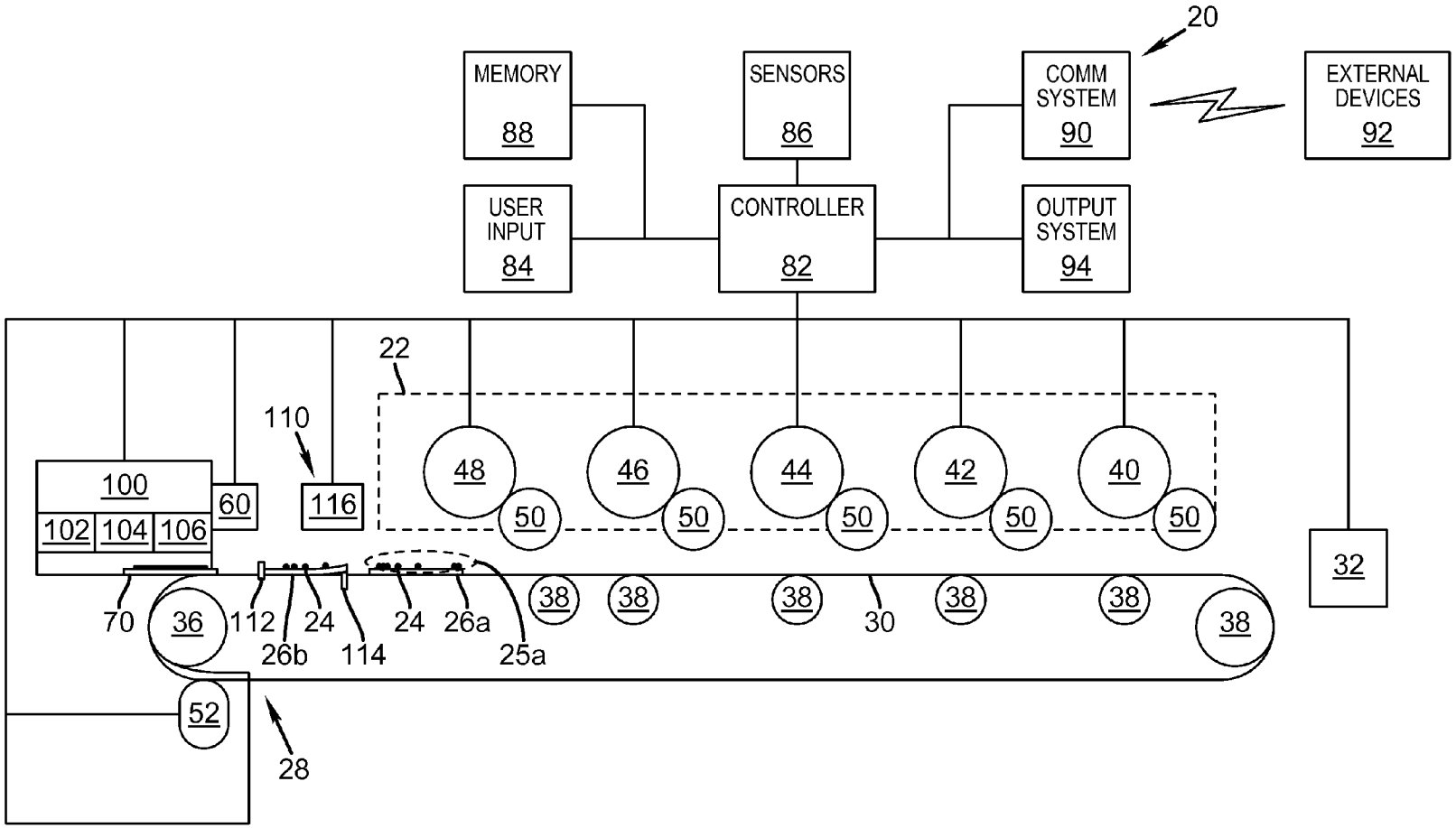
FIG. 2 is a system level illustration of one embodiment of an electrophotographic printer.

FIG. 2 is a system level illustration of an electrophotographic printer 20. In the embodiment of FIG. 2, electrophotographic printer 20 has an electrophotographic print engine 22 that deposits toner 24 to form a toner image 25 in the form of a patterned arrangement of toner stacks. Toner image 25 can include any patternwise application of toner 24 and can be mapped according data representing text, graphics, photo, and other types of visual content, as well as patterns that are determined based upon desirable structural or functional arrangements of the toner 24.

Toner 24 is a material or mixture that contains toner particles, and that can form an image, pattern, or coating when electrostatically deposited on an imaging member including a photoreceptor, photoconductor, electrostatically-charged, or magnetic surface. As used herein, "toner particles" are the marking particles electrostatically transferred by an electrophotographic print engine 22 to form a pattern of material on a receiver 26 to convert an electrostatic latent image into a visible image or other pattern of toner 24 on receiver. Toner particles can also include clear particles that have the appearance of being transparent or that while being generally transparent impart a coloration or opacity. Such clear toner particles can provide for example a protective layer on an image or can be used to create other effects and properties on the image. The toner particles are fused or fixed to bind toner 24 to a receiver 26.

Toner particles can have a range of diameters, e.g. less than 8 μm, on the order of 10-15 μm, up to approximately 30 μm, or larger. When referring to particles of toner 24, the toner size or diameter is defined in terms of the median volume weighted diameter as measured by conventional diameter measuring devices such as a Coulter Multisizer, sold by Coulter, Inc. The volume weighted diameter is the sum of the mass of each toner particle multiplied by the diameter of a spherical particle of equal mass and density, divided by the total particle mass. Toner 24 is also referred to in the art as marking particles or dry ink. In certain embodiments, toner 24 can also comprise particles that are entrained in a wet carrier.

Typically, receiver 26 takes the form of paper, film, fabric, metallicized or metallic sheets or webs. However, receiver 26 can take any number of forms and can comprise, in general, any article or structure that can be moved relative to print engine 22 and processed as described herein.

Returning again to FIG. 1, print engine 22 is used to deposit one or more applications of toner 24 to form toner image 25 on receiver 26. A toner image 25 formed from a single application of toner 24 can, for example, provide a monochrome image or layer of a structure.

A toner image 25 formed from more than one application of toner 24, (also known as a multi-part image) can be used for a variety of purposes, the most common of which is to provide toner images 25 with more than one color. For example, in a four color image, four toners having subtractive primary colors, cyan, magenta, yellow, and black, can be combined to form a representative spectrum of colors. Similarly, in a five color image various combinations of any of five differently colored toners can be combined to form other colors on receiver 26 at various locations on receiver 26. That is, any of the five colors of toner 24 can be combined with toner 24 of one or more of the other colors at a particular location on receiver 26 to form a color different than the colors of the toners 24 applied at that location.

In addition to adding to the color gamut, the fifth color can also be a specialty color toner or spot color, such as for making proprietary logos or colors that cannot be produced with only CMYK colors (e.g. metallic, fluorescent, or pearlescent colors), or a clear toner or tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white light.

In the embodiment that is illustrated, a primary imaging member (not shown) such as a photoreceptor is initially charged. An electrostatic latent image is formed by image-wise exposing the primary imaging member using known methods such as optical exposure, an LED array, or a laser scanner. The electrostatic latent image is developed into a visible image by bringing the primary imaging member into close proximity to a development station that contains toner 24. The toner image 25 on the primary imaging member is then transferred to receiver 26, generally by pressing receiver 26 against the primary imaging member while subjecting the toner to an electrostatic field that urges the toner to receiver 26. The toner image 25 is then fixed to receiver 26 by fusing to become a print 70.

In FIG. 2 print engine 22 is illustrated as having an optional arrangement of five printing modules 40, 42, 44, 46, and 48, also known as electrophotographic imaging subsystems arranged along a length of receiver transport system 28. Each printing module delivers a single application of toner 24 to a respective transfer subsystem 50 in accordance with a desired pattern as receiver 26 is moved by receiver transport system 28. Receiver transport system 28 comprises a movable surface 30 that positions receiver 26 relative to printing modules 40, 42, 44, 46, and 48. In this embodiment, movable surface 30 is illustrated in the form of an endless belt that is moved by motor 36, that is supported by rollers 38, and that is cleaned by a cleaning mechanism 52. However, in other embodiments receiver transport system 28 can take other forms and can be provided in segments that operate in different ways or that use different structures. In an alternate embodiment, not shown, printing modules 40, 42, 44, 46 and 48 can deliver a single application of toner 24 to a composite transfer subsystem 50 to form a combination toner image thereon which can be transferred to the receiver.

Electrophotographic printer 20 is operated by a printer controller 82 that controls the operation of print engine 22 including but not limited to each of the respective printing modules 40, 42, 44, 46, and 48, receiver transport system 28, receiver supply 32, transfer subsystem 50, to form a toner image 25 on receiver 26 and to cause fuser 60 to fuse toner image 25 on receiver 26 to form prints 70 as described herein.

A printer controller 82 operates electrophotographic printer 20 based upon input signals from a user input system 84, sensors 86, a memory 88 and a communication system 90. User input system 84 can comprise any form of transducer or other device capable of receiving an input from a user and converting this input into a form that can be used by printer controller 82. For example, user input system 84 can comprise a touch screen input, a touch pad input, a 4-way switch, a 6-way switch, an 8-way switch, a stylus system, a trackball system, a joystick system, a voice recognition system, a gesture recognition system or other such systems. Sensors 86 can include contact, proximity, magnetic, or optical sensors and other sensors known in the art that can be used to detect conditions in electrophotographic printer 20 or in the environment-surrounding electrophotographic printer 20 and to convert this information into a form that can be used by printer controller 82 in governing printing, fusing, finishing or other functions. Memory 88 can comprise any form of conventionally known memory devices including but not limited to optical, magnetic or other movable media as well as semiconductor or other forms of electronic memory. Memory 88 can be fixed within electrophotographic printer 20 or removable from electrophotographic printer 20 at a port, memory card slot or other known means for temporarily connecting a memory 88 to an electronic device. Memory 88 can also be connected to electrophotographic printer 20 by way of a fixed data path or by way of communication system 90.

Communication system 90 can comprise any form of circuit, system or transducer that can be used to send signals to or receive signals from memory 88 or external devices 92 that are separate from or separable from direct connection with printer controller 82. Communication system 90 can connect to external devices 92 by way of a wired or wireless connection. In certain embodiments, communication system 90 can comprise any circuit that can communicate with one of external devices 92 using a wired connection such as a local area network, a point-to-point connection, or an Ethernet connection. In certain embodiments, communication system 90 can alternatively or in combination provide wireless communication circuits for communication with separate or separable devices using, for example, wireless telecommunication or wireless protocols such as those found in the Institute of Electronics and Electrical Engineers Standard 802.11 or any other known wireless communication systems. Such systems can be networked or point to point communication.

External devices 92 can comprise any type of electronic system that can generate signals bearing data that may be useful to printer controller 82 in operating electrophotographic printer 20. For example and without limitation, one example of such external devices 92 can comprise what is known in the art as a digital front end (DFE), which is a computing device that can be used to provide an external source of a print order that has image data and, optionally, production data including printing information from which the manner in which the images are to be printed can be determined. Optionally the production data can include finishing information that defines how the images that are provided are to be processed after printing. A print order that is generated by such external devices 92 is received at communication system 90 which in turn provides appropriate signals that are received by communication system 90.

Similarly, the print order or portions thereof including image and production data can be obtained from any other source that can provide such data to printer 20 in any other manner, including but not limited to memory 88. Further, in certain embodiments image data and/or production data or certain aspects thereof can be generated from a source at printer 20 such as by use of user input system 84 and an output system 94, such as a display, audio signal source or tactile signal generator or any other device that can be used by printer controller 82 to provide human perceptible signals for feedback, informational or other purposes.

As is shown in FIG. 2, electrophotographic printer 20 further comprises an optional finishing system 100. Finishing system 100 can be integral to printer 20 or it can be separate or separable from printer 20. In the illustrated embodiment finishing system 100 optionally includes a cutting system 102, a folding system 104, and/or a binding system 106. Cutting system 102 can comprise any form of automatic cutting system that can be used to cut a print 70 in at least two parts. Similarly, folding system 104 can comprise any form of automatic folding system that can be used to fold a print 70. Binding system 106 can include conventional wire, ring, staple, or adhesive based systems that apply a material or fastener or that otherwise cause two or more prints 70 to be bound together.

Figure 3:
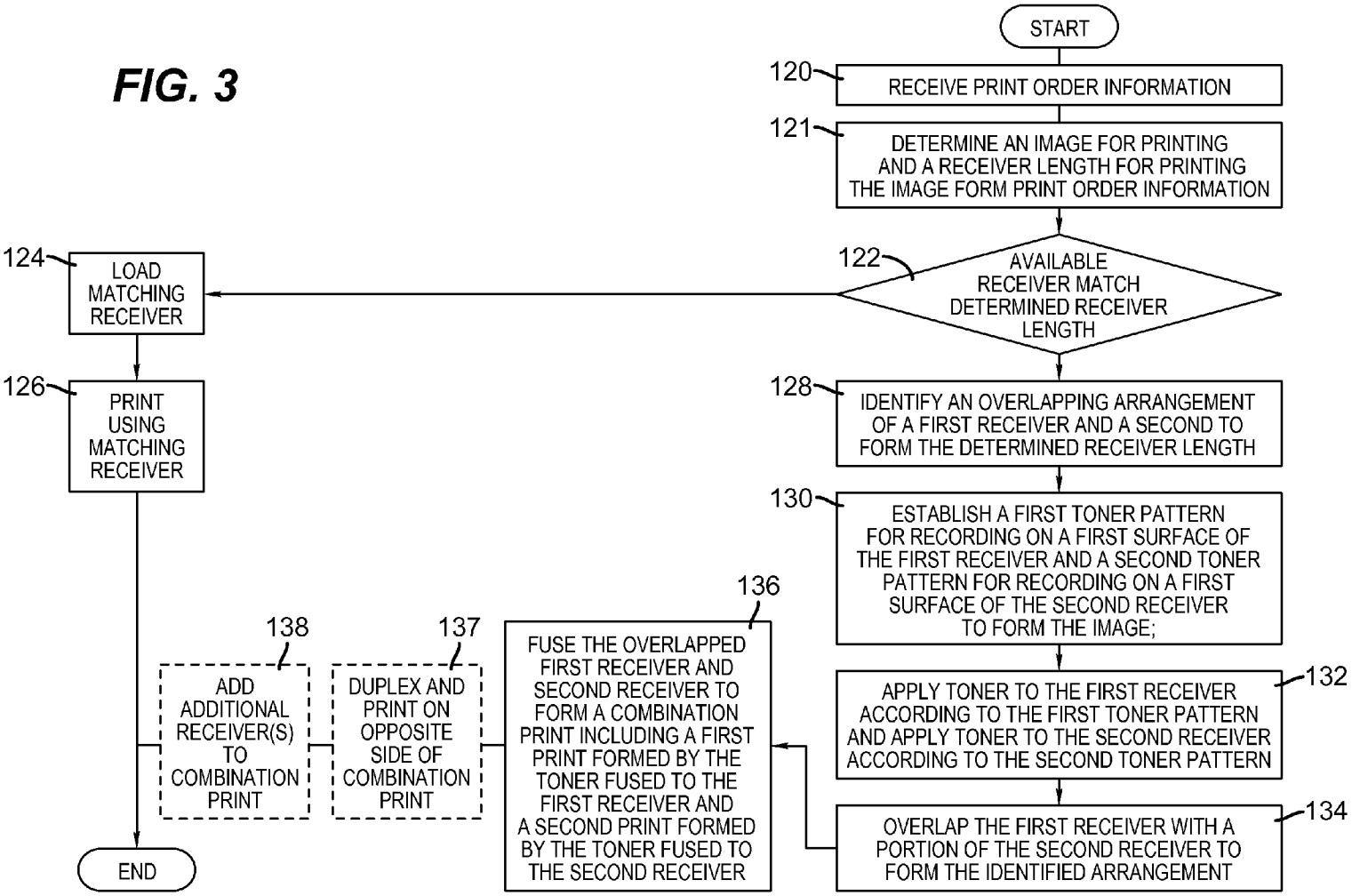
FIG. 3 shows a flow chart of a first embodiment of a method for using a printer to form a durable combination of printed receivers.

FIG. 3 shows a flow chart depicting first embodiment of a method for forming prints of a determined length. As is shown in the embodiment of FIG. 3, in a first step, a print order is received including information from which an image to be printed and a receiver length L for printing the image can be determined. The print order can be received, for example, from communication system 90, user input system 84, or memory 88 (step 118).

Printer controller 82 uses the information in the print order to determine an image for printing and a length of receiver L to be used in printing the image (step 120). In this regard, the print order can generally comprise any type of data or instructions that printer controller 82 can use to determine an image for printing and a length L of the receiver onto which the determined image is to be printed. For example, and without limitation, the print order can comprise image data such as an image data file that defines the determined image and associated data providing printing instructions that define the length L of receiver 26. In another example, the print order can comprise instructions or data that will allow printer controller 82 and communication system 90 to obtain an image data file from external devices 92. Further, in other embodiments the print order can contain data from which printer controller 82 can generate the determined image for example from an algorithm or other mathematical or other formula.

The determined image includes the entirety of what is to be printed on a single combination of receivers by printer 20. The determined image can include image information from separate data files and/or separate locations, and/or other types of image information. The determined image can comprise any pattern that can be recorded using one or more applications of toner.

Receiver length L can be determined based upon information from the print order as generally described in the examples above. In other embodiments, signals from user input system 84 can be used as the basis for determining the receiver length L. In still other embodiments, receiver length L can be determined by analysis of the designated image such as may occur by determining an aspect ratio for the determined image and determining a receiver length L based upon the aspect ratio and a required size of the receiver. The receiver length L can also be determined based upon analysis of other information in the print order. For example, the print order can include production data or other types of data or instructions from which the receiver length L can be calculated or otherwise automatically determined, or data indicating a location from which such data can be obtained by printer controller 82 such as by way of communication system 90. In certain embodiments the print order data can include information that identifies a mounting into which the image is to be placed. This can include for example a frame, pocket, pouch or other surface that is associated with a defined area for housing or mounting a receiver having a certain length. Printer controller 82 can be used to determine the receiver length L based upon this information for example, by reference to a look up tables or databases that can be stored in memory 88 or that are available by way of communication system 90, or can determine information from such sources allowing printer controller 82 to determine a receiver length L by way of calculation. Printer controller can also determine the receiver length from information in the print order from which a print size can be determined or a user input from which information indicating a receiver length can be determined.

Printer controller 82 then determines whether printer 20 has a receiver 26 available for printing having a length that matches the determined receiver length L (step 122). Where printer controller 82 determines that there is such a receiver 26 available for printing, printer controller 82 can cause, for example, receiver supply 32 to supply such receiver 26 for use in printing or can activate manual loading processes that enable a user to load receiver 26 of the matching length onto receiver transport system 28 (step 124). The determined image is then printed on the matching receiver (step 126).

Forming Combination Print of Determined Length

Where printer controller 82 determines that receivers 26 available at printer 20 do not have lengths that correspond to the determined receiver length L (step 122) printer controller 82 identifies an arrangement of overlapping receivers 26*a*, 26*b* etc. that forms the determined receiver length L (step 128).

Figure 4A:
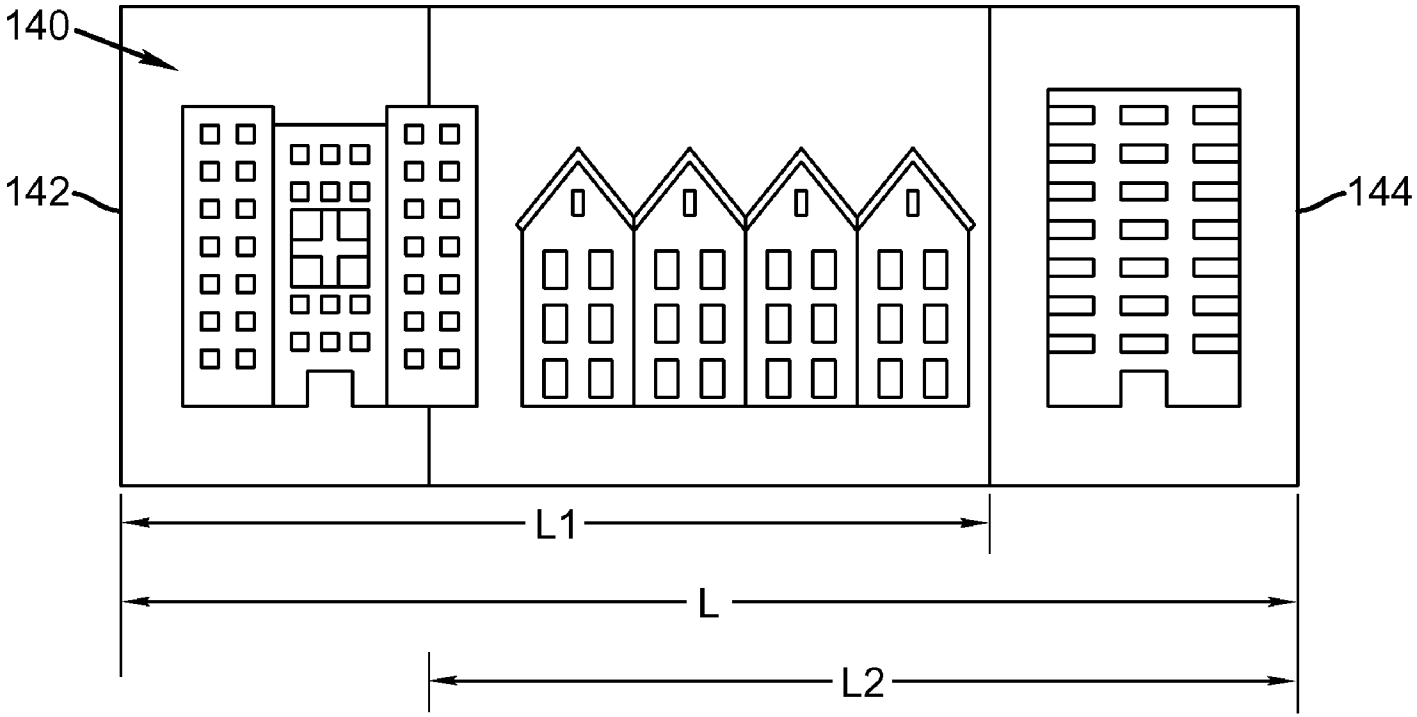
FIG. 4A shows one example of an image and receiver length that can be determined from a print order.

One example of this will now be explained with reference to FIGS. 4A-4E. FIG. 4A shows one example of an image 140 and receiver length L that can be determined from information in a print order. In this example, a borderless print is ordered, accordingly, here the receiver length L corresponds a distance from a first edge 142 of image 140 to a second edge 144 of image 140. However, in other examples, determined receiver length L can be longer than that required to print determined image 140. This can be done, as is known in the art, to provide a bordered print or for other aesthetic or functional reasons.

In this example, printer controller 82 determines a length L1 of a first receiver 26*a* and a length L2 of a second receiver 26*b* that are available for printing. In the example shown in FIGS. 4A-4D, L1 and L2 are equal, however, this is not necessarily so.

Printer controller 82 then identifies an overlapping arrangement of first receiver 26*a* and second receiver 26*b* that forms the determined receiver length L (step 128). In one embodiment, printer controller 82 identifies the type or types of receiver available at receiver supply 32 and determines from the type or types available any number of arrangements of available receivers 26 that can provide determined receiver length L. The selection of the receivers 26 for use in this fashion can be made in any of a variety of ways. In one, example printer controller 82 can select a combination of receivers 26 from a look up table identifying a preferred combination of the available receivers 26 to make a receiver having the determined receiver length L. By way of example, and not limitation, printer controller 82 can determine an arrangement of available receivers 26 by way of calculation, or fuzzy logic or iterative techniques known in the art.

After the arrangement of available receivers 26 is determined, a first toner pattern is established for recording on a first side of the first receiver and a second toner pattern for recording on a first side of the second receiver to form the image (step 130). This process involves portioning determined image 140 into portions that will be provided on a first print 160 to be formed on first receiver 26*a* and second print 180 formed on second receiver 26*b*. In the example of FIGS. 4A-4E, image 140 is portioned by printer controller 82 according to the extent to which a first side 162 of first print 160 and a first side 182 of second print 180 are visible when overlapped to provide determined receiver length L.

Figure 4B:
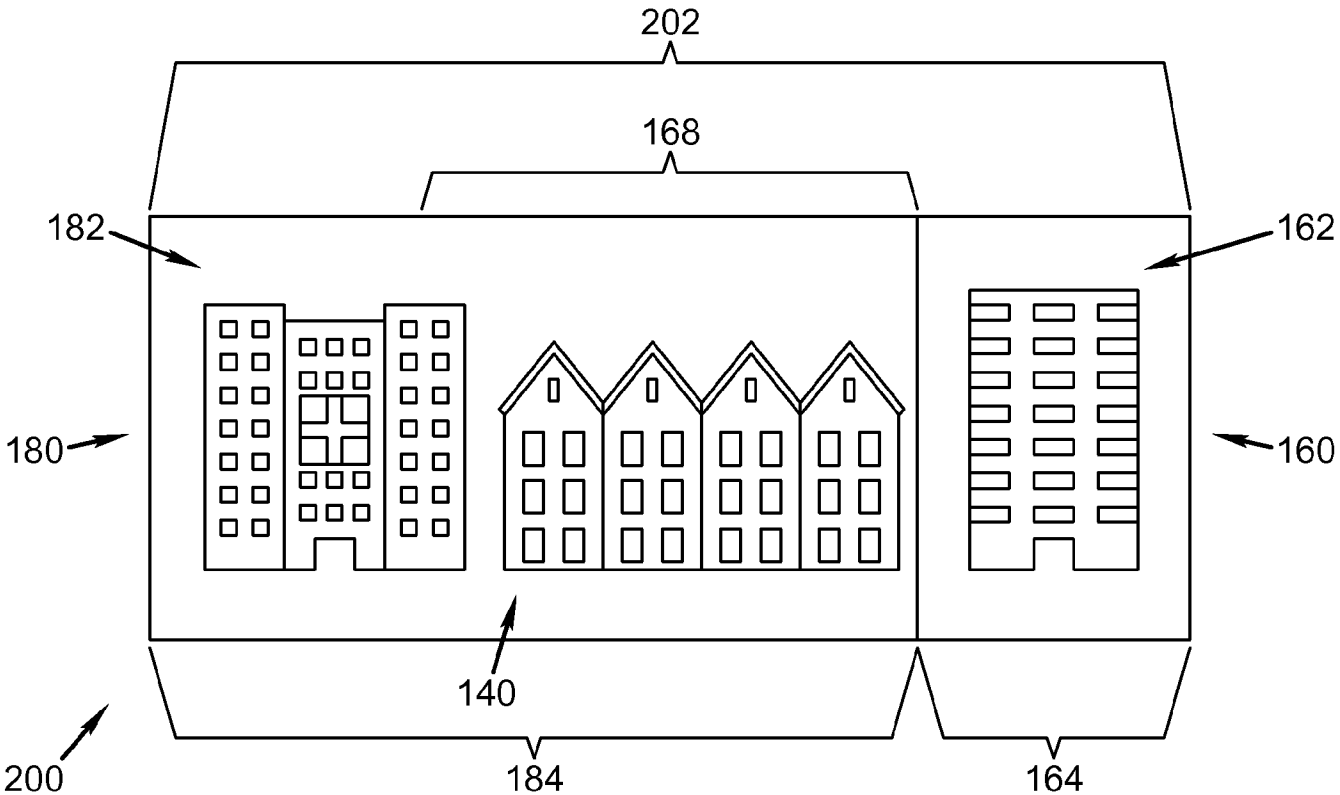
FIG. 4B shows one example of a combination print.

FIG. 4B shows one example of a combination print 200 that presents determined image 140 across a determined receiver length L provided by a first print 160 formed using first receiver 26*a* that is overlapped by a second print 180 formed using second receiver 26*b* according to the previously determined overlapped arrangement with first receiver 26*a*. As is shown in the example of FIG. 4B, combination print 200 has first side 202 that is formed from a non-overlapped portion 164 of a first side 162 of first print 160 and the entire first side 182 of second print 180. In this example, 70% of first side 202 of combination print 200 is provided by first side 182 of second print 180, while a remaining 30% of first side 202 of combination print 200 is supplied by the non-overlapped portion 164 of first side 162 of first print 160.

Accordingly, in this example, printer controller assigns 70% of image 140 for printing on entire portion 184 on first side 182 of second receiver 26*b* and assigns 30% of image 140 for printing in the non-overlapped portion 164 of first print 160.

Figure 4C:
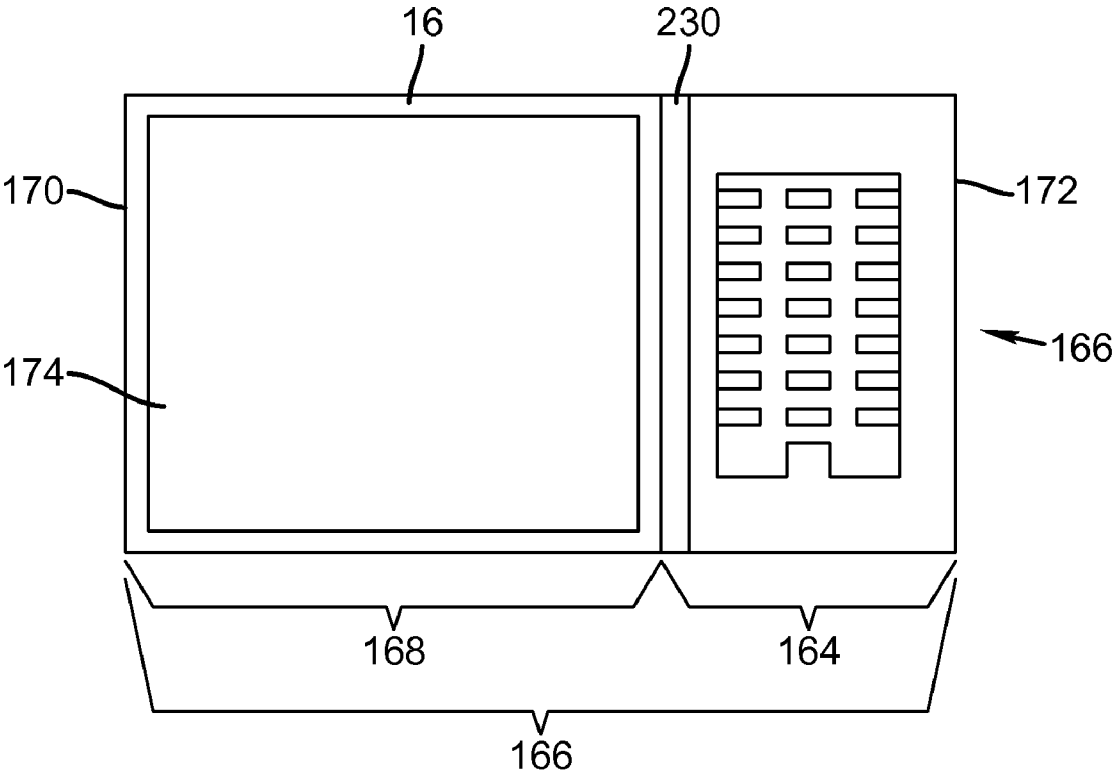
FIG. 4C shows one example of a first toner image on a first receiver.

First and second toner patterns are then established for recording determined image 140 using the predetermined arrangement of first receiver 26*a* and second receiver 26*b*. FIG. 4C, shows an example of a first toner pattern 166 generated by printer controller 82 for recording as a first toner image on first receiver 26*a* to form first print 160. In this example, printer controller 82 assigns 30% of determined image 140 to be printed in the non-overlapped portion 164. The portion of image 140 assigned to be printed in non-overlapped portion 164 extends from second edge 144 of image 140 lengthwise toward first edge 142 to encompass 30% of determined image 140.

As can also be seen in FIG. 4C, first toner pattern 166 includes a pattern 174 of toner 24 that is recorded on overlap area 168. The toner 24 recorded on overlap area 168 bonds first receiver 24*a* to second receiver 24*b* during fusing. To most effectively bond first receiver 26*a* to second receiver 26*b* using toner 24, it can be useful to provide a relatively uniform monolayer of toner 24 throughout the entire bonding region i.e. across overlap area 168 as is shown. This is because variability in the density or height of toner 24 in overlap area 168 can create pockets of weak bonding where there is insufficient toner 24 resulting in incomplete coverage of in the overlap region, which would result in weak bonding between first receiver 26*a* and second receiver 26*b*. Conversely, thick or high density application of toner 24 in overlap area 168 often require the use a multilayer application of toner, which can also have reduced bonding strength where for example, weaknesses can develop in inter-layer bonds.

Accordingly, while it is possible to provide image content or other printed patterns in the toner 24 that is applied to overlap area 168, printer controller 82 will typically determine an extent to which any patterns of toner are to be formed in overlap area 168 based upon the extent of the bond required between first receiver 26*a* and second receiver 26*b*. This analysis can consider, for example, the extent of the overlap, the ability of the toner 24 in the overlap area 168 to form a bond between with first receiver 26*a* and second receiver 26*b* and other factors that may place stress on such a bond.

Optionally, the pattern of toner 24 in overlap area 168 of first print 160 can be printed to provide an additional portion of image 140 that matches a portion of image 140 printed near second edge 192 of second receiver 26*b*. This can be done to help ensure image continuity between first print 160 and second print 180 in the event of minor alignment errors during positioning, fusing or afterward.

Also shown in the first toner pattern 166 is an inter-print toner area 230 which will be described in greater detail below.

Figure 4D:
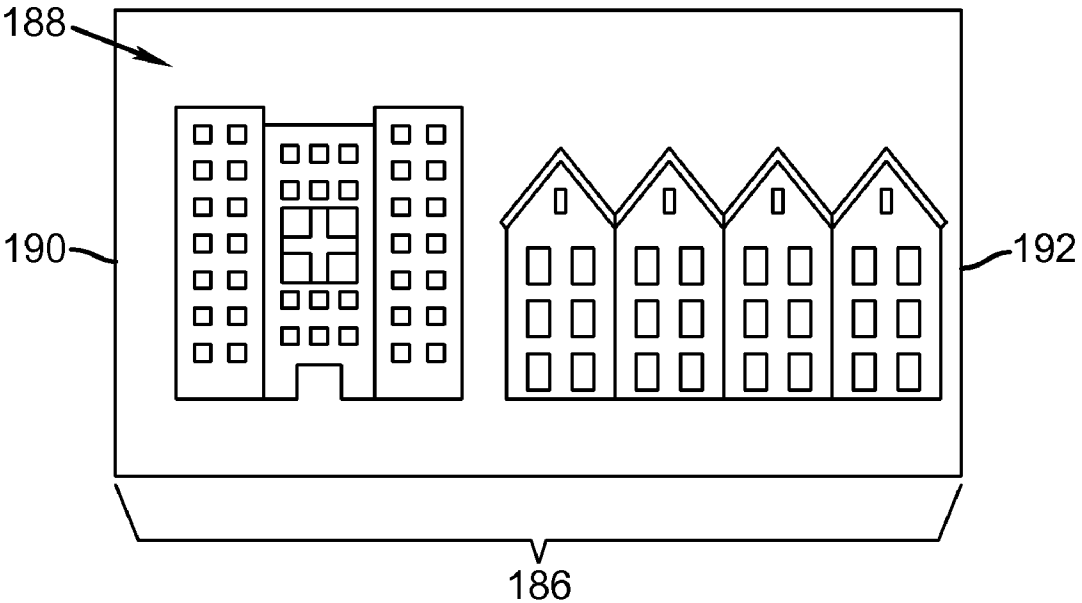
FIG. 4D shows one example of a second toner image on a second receiver.

FIG. 4D, shows a second toner pattern 186. Second toner pattern 186 is used by printer controller 82 and print engine 22 in forming a second toner image on second receiver 26*b* that will form second print 180 after fusing. As is shown here, second toner pattern 186 has an image content portion 188 that is provided to extend from a first edge 190 to a second edge 192. The image content portion of second toner pattern 186 includes a portion of image 140 that begins at first edge 142 of image 140 and extends toward second edge 144 to include 70% of image 140.

Referring again to FIG. 3, first print 160 and second print 180 are then formed when first toner pattern 166 and second toner pattern 186 are converted into first toner image 25*a* and second toner image 25*b* printed on first receiver 26*a* and second receiver 26*b* respectively by print engine 22 in cooperation with receiver transport system 28 and in accordance with instructions provided by printer controller 82 (step 132). This can be done in any conventional manner for printing toner images on a receiver.

Printer controller 82 then causes first receiver 26*a* and second receiver 26*b* to be moved so that second receiver 26*b* overlaps first receiver 26*a* to an extent that is necessary to position second edge 172 according to the identified arrangement. This requires two things, that the second edge 192 of second receiver 26*b* be moved past first edge 170 of first receiver without collision at the edges which can create paper jams and attendant maintenance problems and that second edge of second receiver 26*b* be moved to a position where the distance from the first edge 190 of second receiver 26*b* and the second edge of second receiver 26*b* provide the determined receiver length L.

Accordingly, printer 20 incorporates an overlap positioning system 110 proximate to the receiver transport system that is adapted to cooperate with receiver transport system 28 to enable a non-collision overlap to occur.

In the embodiment of printer 20 shown in of FIG. 2, an overlap positioning system 110 is provided proximate to receiver transport system 28 to achieve this result. In this embodiment, overlap positioning system 110 comprises a stop 112 that can be movably positioned along movable surface 30 between a first position that does not interfere with the movement of a receiver 26 on movable surface 30 and a position that stops the movement of a leading edge of a receiver 26 after a toner image has been formed on second receiver 24*b* while not interfering with movement of first receiver 26*a* toward second receiver 26*b*.

In this embodiment of overlap positioning system 110, a positioner 114 lifts a trailing edge of second receiver 26*b* allowing first receiver 26*a* to be advanced under and relative to second receiver 26*b*.

A position sensing system 116 cooperates with printer controller 82 to determine when second receiver 26*b* overlaps first receiver 26*a* to form the overlapping arrangement of first receiver 26*a* and second receiver 26*b* that provides determined receiver length L.

Position sensing system 116 can comprise, for example, a one or more types of sensors including but not limited to contact, electro-mechanical, electrical, magnetic or optical sensors that can detect the presence or absence of a receiver, an edge of a receiver, proximity of a receiver or an extent of movement of a receiver. In certain embodiments, position sensing system 116 can include a video or still image sensor. It will be appreciated that other arrangements are possible.

In an alternative embodiment stop 112 holds first receiver 26*a* after printing while allowing second receiver 26*b* to be more toward first receiver 26*a*. Here, positioned 114 positions first edge 170 of first receiver 26*a* in a downward direction to allow a second edge 192 of second receiver 26*b* to move past first edge 170 of first receiver 26*a* without a collision. In other alternative embodiments, positioner 114 can depress second edge of second receiver 26*b*.

Positioner 114 can comprise, for example, mechanical, pneumatic, hydraulic, vacuum, or electrostatic systems of conventional design that can adjust the vertical position of either of first edge 170 of first receiver 26*a* or second edge 192 of second receiver 26*b* to allow receiver transport system 28 to move these receivers into an overlapping position without collision. Any system that can be used for such a purpose can be employed here.

In other embodiments, positioner 114 can be arranged along receiver transport system 28 to position of first receiver 26*a* or second receiver 26*b* as necessary to allow overlapping of the first receiver 26*a* by the second receiver 26*b* avoid collision of the first edge 170 of first receiver 26*a* with second edge 192 of second receiver 26*b*, without stopping movement of first receiver 26*a* along receiver transport system 28. Where this is done, printer controller 82 causes receiver transport system 28 to create rate of movement differential between the rate of movement of first receiver 26*a* and the rate of movement of second receiver 26*b* that allows second edge 192 of second receiver 26*b* to advance past first edge 170 of first receiver 26*a* until a sufficient extent of overlap is reached to provide the determined receiver length L. In this regard, either the rate of movement of first receiver 26*a* can be slowed or the rate of movement of second receiver 26*b* can be increased as necessary. Once that first receiver 26*a* and second receiver 26*b* are positioned in the identified arrangement, the rate of movement of first receiver 26*a* and second receiver 26*b* are be equalized.

Figure 5A:
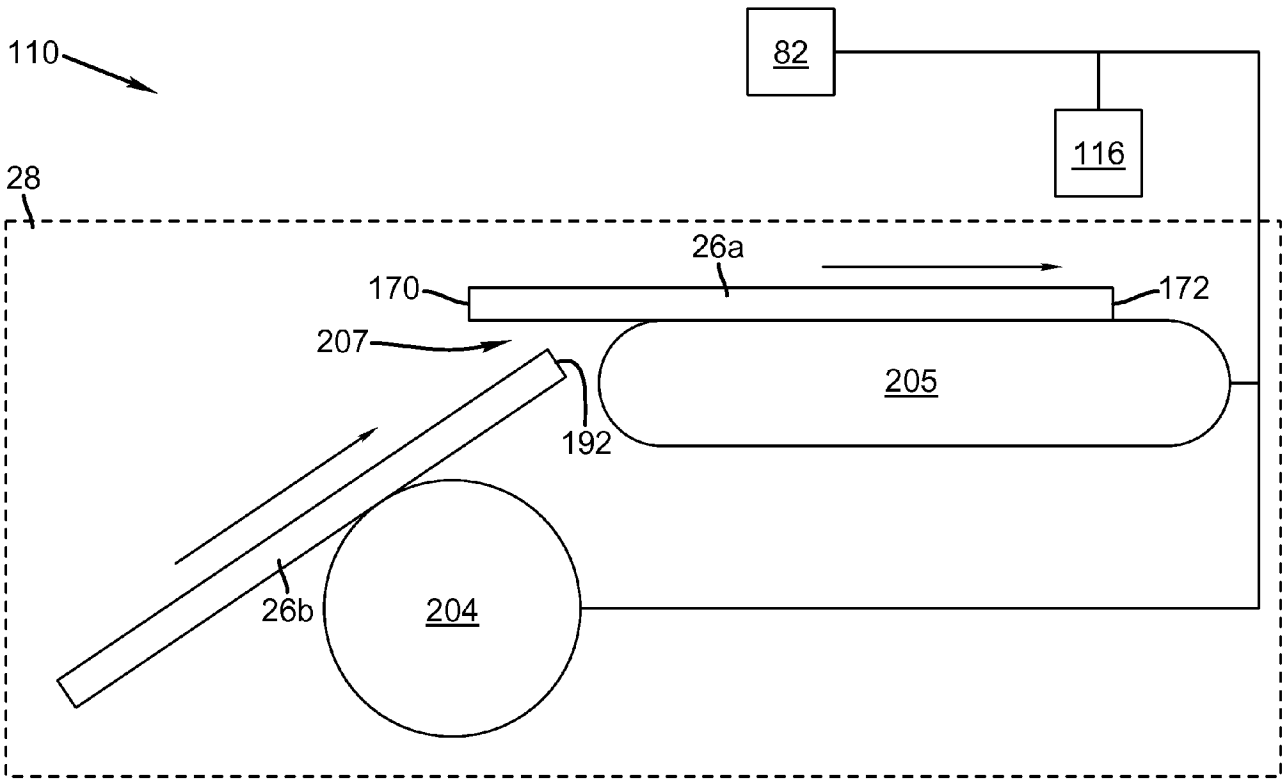
FIG. 5A shows one example of an overlap positioning arrangement.

As is shown in FIG. 5A a receiver transport system 28 can be arranged to cooperate with overlap positioning system 110 to avoid edge to edge collisions during overlapping. In this example, guides or other combination of surfaces such as roller 204 and belt 205 that draw first receiver 26*a* around a curved path 206 such that the first edge 170 departs momentarily from a path of travel of second edge 172 and that is cantilevered such that a separation 207 is created between first edge 170 and a second edge 192 of second receiver 26*b* allowing second receiver 26*b* to be moved into an overlapping position beyond first edge 170 without collision. A position sensing system 116 has at least one detector to detect first edge 170 or second edge 172 of first receiver 26*a* or otherwise detects a position of first receiver 26*a* and sends appropriate signals to printer controller 82 so that printer controller 82 can operate roller 204 and belt 205 to cause the overlap to occur when first receiver 26*a* is overlapped with second receiver 26*b* according to the identified arrangement.

Figure 5B:
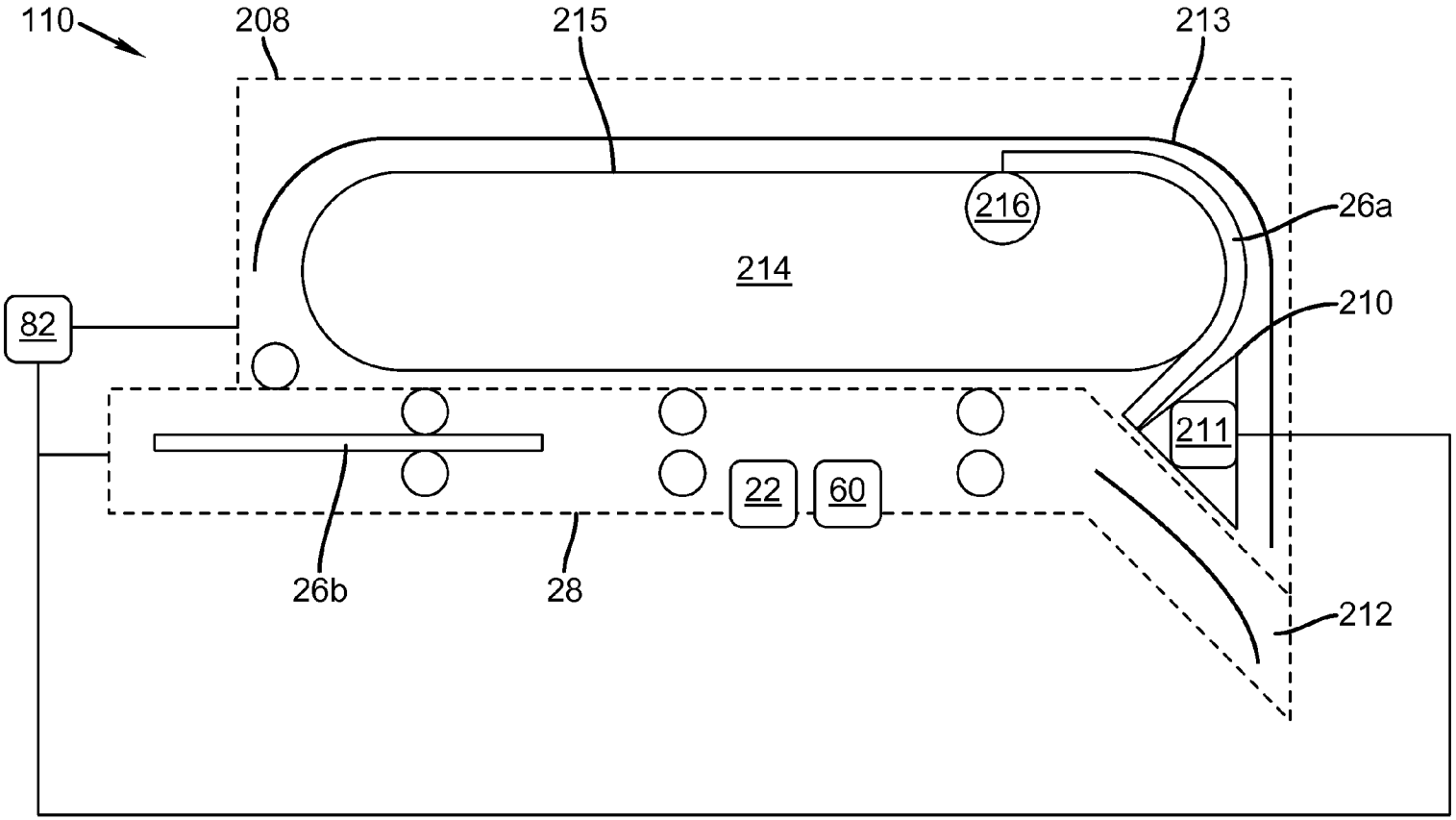
FIG. 5B shows one example embodiment of an overlap positioning system.

As is shown in FIGS. 5B-5E, overlap positioning system 110 can take other forms. In the embodiment that is illustrated in FIG. 5B, overlap positioning system 110 has a recirculation system 208 with a diverter 210 with an actuator 211 that causes diverter 210 to move in response to signals from printer controller 82. Diverter 210 is located proximate to a post-printing path 212 of receiver transport system 28 and can be moved by diverter actuator 211 between a first position where the first receiver 26*a* travels into recirculation system 208 and a second position where first receiver 26*a* travels along post-printing path 212. As is illustrated in FIG. 5B, printer controller 82 has caused diverter actuator 211 to position diverter 210 to divert first receiver 26*a* into recirculation system 208. In another position (not illustrated in FIG. 5B), actuator 211 can position diverter 210 to guide first receiver 26*a* into a post printing path 212 of receiver transport system 28. It will be appreciated that this embodiment is exemplary only and that any arrangement of a receiver transport system 28 and diverter 210 that can cause a printed receiver to travel between one of two different paths can be used for this purpose.

Figure 5C:
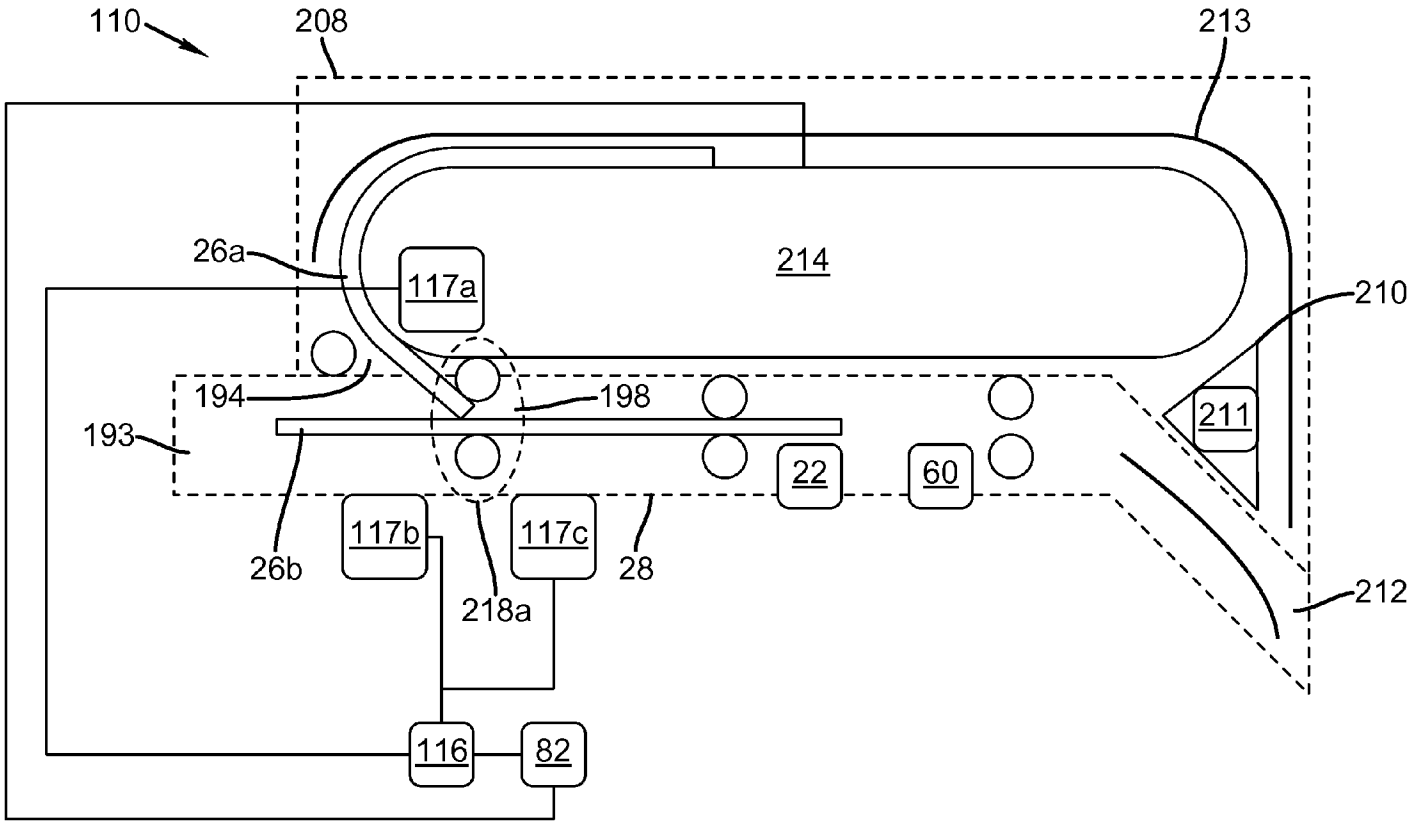
FIG. 5C shows the embodiment of FIG. 5B with the first receiver in a different position.

As is shown in FIG. 5C, recirculation system 208 has a set of surfaces 213 shown here as guides and rollers that direct first receiver 26*a* from the post printing path 212 to a reentry position 198 in a pre-printing path 193 of receiver transport system 28 where receiver transport system 28 can control movement of first receiver 26*a*.

Overlap positioning system 110 also provides a receiver movement system 216 shown here as taking the form of a combination of motors 217 that drive particular rollers 215. Printer controller 82 sends signals to receiver movement system 214 causing motorized rollers 216 to direct first receiver 26*a* back to receiver transport system 28 to the reentry position.

In this embodiment, position sensing system 116 provides at least one sensor that can sense conditions in recirculation system 208 from which the position of first receiver 26*a* from which it can be determined when first receiver 26*a* is positioned where first receiver 26*a* can be moved to a receiver staging position 213 from which first receiver 26*a* can be moved to the reentry position within a predetermined time and from which the extent to which a portion of second receiver 26*b* will have moved past the reentry point 198 after the predetermined period of time can be determined. In the embodiment of FIGS. 5B-5F position sensing system 116 provides a first sensor 117*a* that detects when a leading edge of first receiver 26*a* is positioned at a staging position 194 and a second sensor 117*b* that detects second receiver 26*b* and a third sensor 117*c* that monitors the amount of rotation of first motorized rollers 218*a*. In other embodiments, position sensing system 116 can use other arrangements of sensors 117 to generate signals from which such information or equivalents of such information can be determined. Position sensing system 116 can include any type of sensor that can sense a receiver, or measure movement of a receiver and can comprise without limitation an optical, mechanical, electrical, electro-magnetic sensors or sensing systems for example.

Printer controller 82 use the signals from position sensing system 116 to, measure, calculate or otherwise determine when second receiver 26*b* is located at a staging position 221 along receiver transport system 28 where reentry of first receiver 26*a* into receiver transport system 28 at the reentry point 198 will cause first receiver 26*a* and second receiver 26*b* to be positioned with an amount of overlap required to form in the identified overlapping arrangement.

Figure 5D:
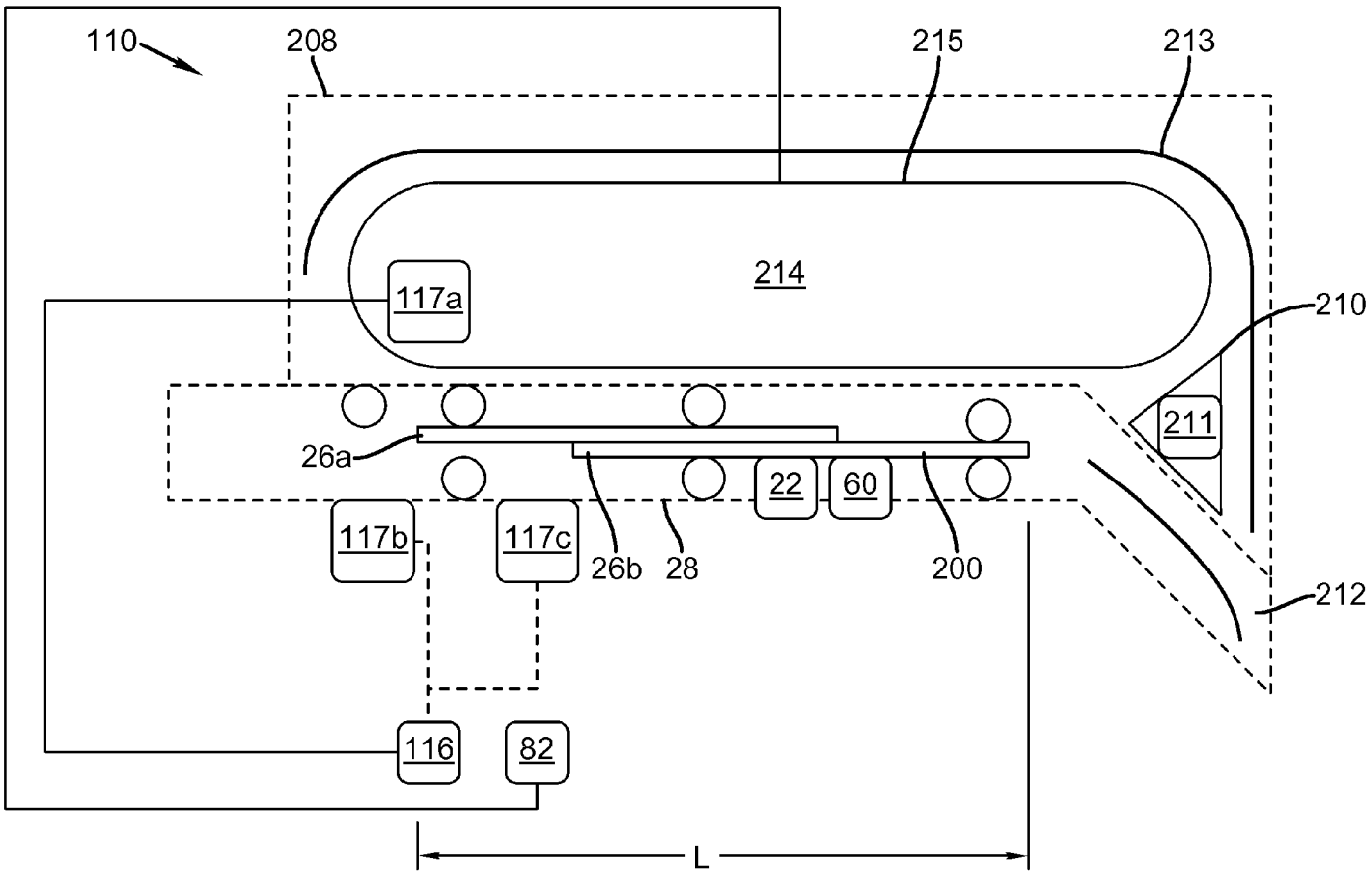
FIG. 5D shows the embodiment of FIG. 5C with the first receiver overlapping the second receiver.

Printer controller 82 causes the receiver movement system 214 to drive first receiver 26*a* to reenter receiver transport system 28 at reentry point 198 and then causes receiver transport system 28 to move first receiver 26*a* and second receiver 26*b* in unison past print engine 22 and fuser 60 as is illustrated in FIG. 5D.

Such reintroduction can be done with second receiver 26*b* being stationary or moving as desired.

It will be appreciated that where a portion of the determined image is recorded on either of first receiver 26*a* or second receiver 26*b* at the time of overlapping, it can become important to the appearance of certain images that the overlapping be done accurately to ensure image continuity and to ensure that the rendered combination print 200 has the determined length L. However, that there are many variables that can influence the exact timing of the reintroduction of first receiver 26*a* into the receiver transport system 28 and that can cause variations in the amount of overlap. Such variables include among other things sheet-to-sheet receiver length variability, receiver thickness variability, variability in detection or variability in the location of the receiver.

Figure 5E:
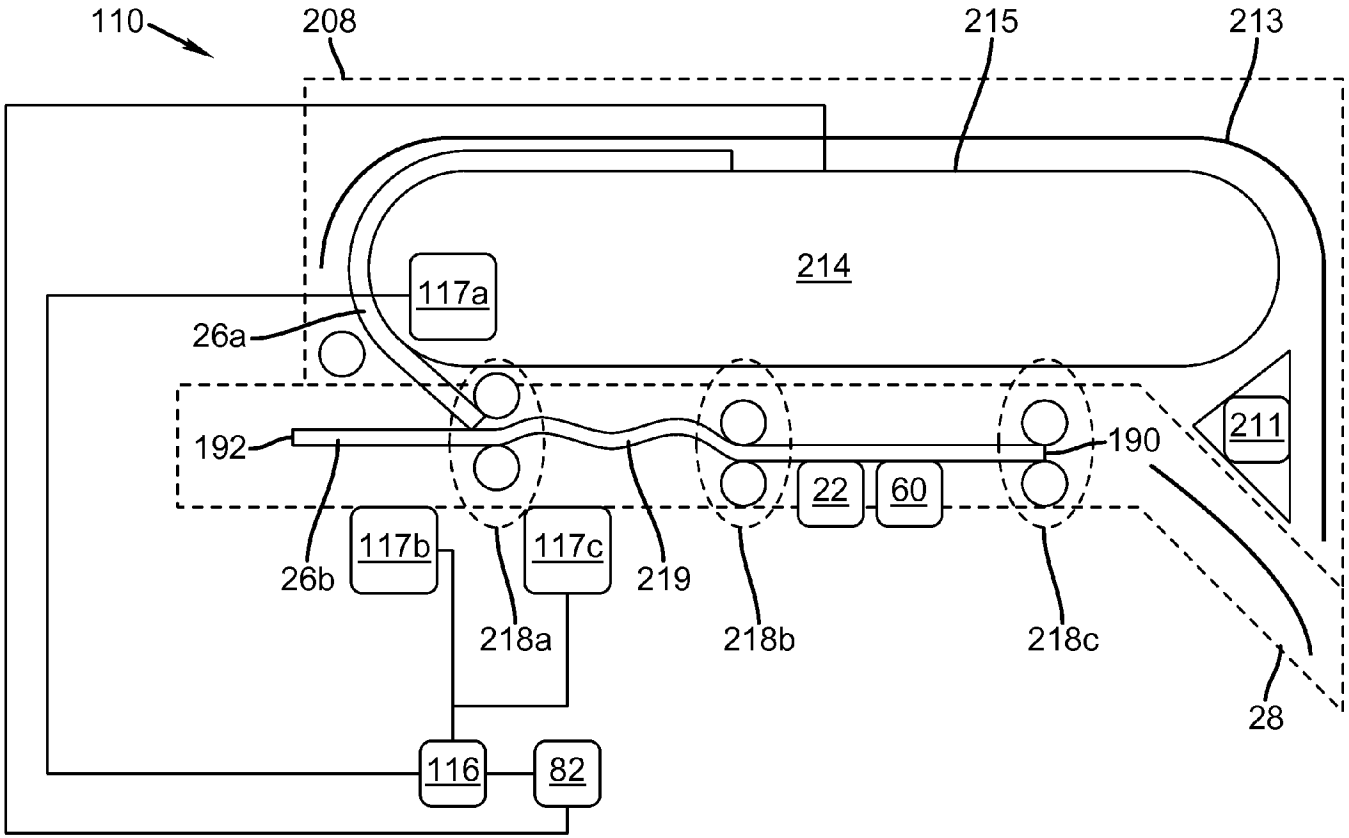
FIG. 5E shows another embodiment of overlap positioning system.

Accordingly, in the embodiment that is illustrated in FIG. 5E, receiver transport system 28 provides a roller system 218 having first motorized rollers 218*a* positioned to form a nip at reentry point 221 where first receiver 26*a* rejoins second receiver 26*b* and second motorized rollers 218*b* and third motorized rollers 218*c* that are positioned to provide precise control of movement of first receiver 26*a* and second receiver 26*b* past print engine 22 and fuser 60. However, in this embodiment, printer controller 82 causes first motorized rollers 218*a* to move first receiver 26*a* past first motorized rollers 218*a* at a rate of movement that is greater than a rate of movement provided by second motorized rollers 218*b* and third motorized rollers 218*c*. This causes a buckle 219 to form between first motorized rollers 218*a* and second motorized rollers 218*b* and third motorized rollers 218*c*. Buckle 219 allows a period of time where movement of second edge 192 of second receiver 26*b* toward first motorized rollers 218*a* can be temporarily stopped without interruption of the movement of first edge 190 or other portions of second receiver 26*b* by second motorized rollers 218*b* and 218*c*. This period of time is at least as long as the period of time required to move first receiver 26*a* from a recirculation path staging position 223 proximate to the reentry point 221.

In this embodiment, the movement of second receiver 26*b* past first motorized rollers 218*a* is sensed by position sensing system 116 and stopped when a portion of second receiver 26*b* extending from a nip between first motorized rollers 218*a* that corresponds to the portion of second receiver 26*b* that is to overlap first receiver 26*a*. Printer controller 82 then causes receiver movement system 214 to move first receiver 26*a* from the recirculation path staging position 221 toward the nip between first motorized rollers 218*a* such that first edge 170 of first receiver 26*a* is positioned against the nip between first motorized rollers 218*a*.

Figure 5F:
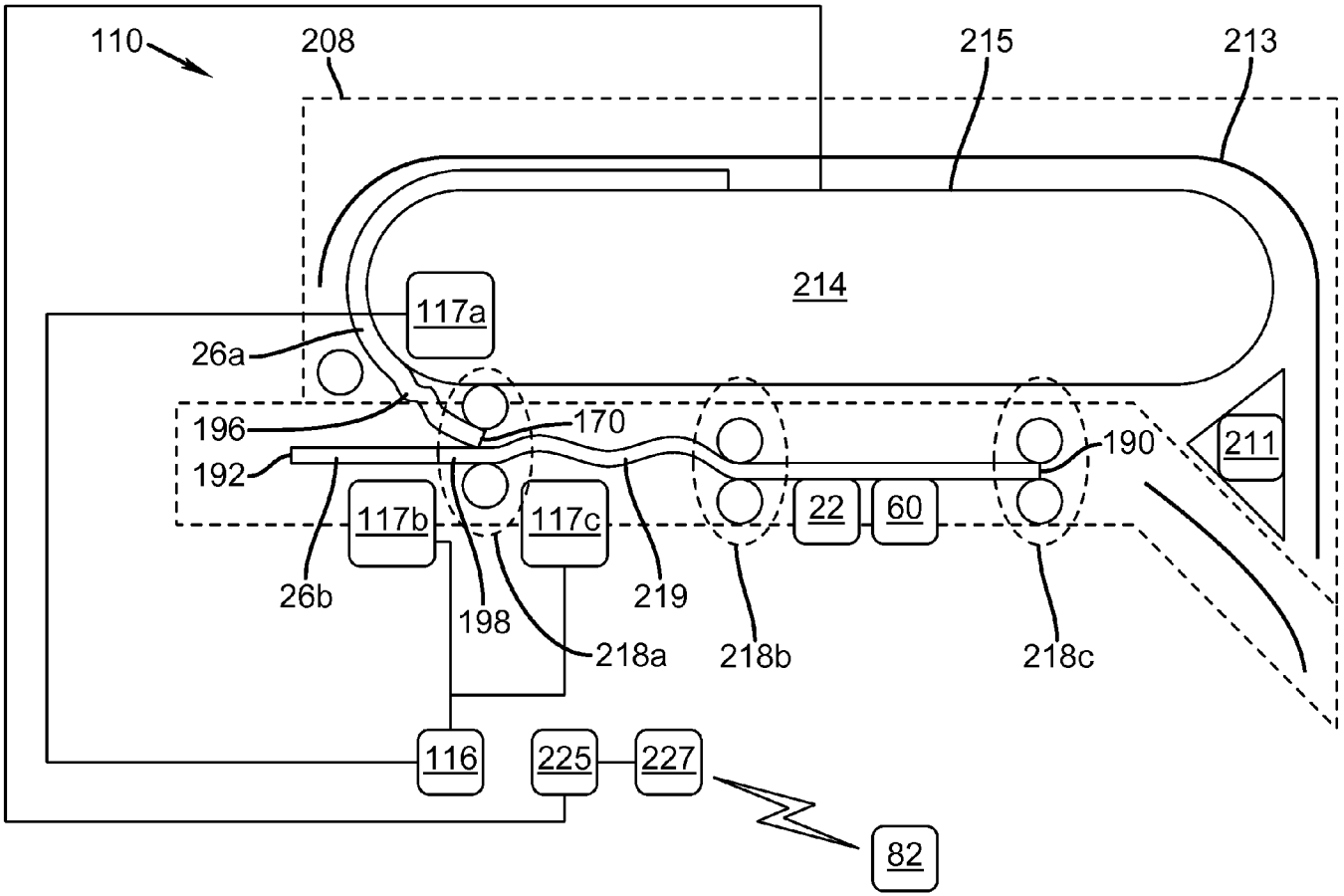
FIG. 5F shows still another embodiment of an overlap positioning system.

Optionally, as is shown in FIG. 5F, printer controller 82 can cause first receiver 26*a* to be advanced to the reentry point 196 at the nip area between first motorized rollers 218*a* while first motorized rollers 218*a* are stopped. This forms a buckle 196 that generates a force to thrust first edge 170 of first receiver 26*a* in manner that ensures that first edge 170 is evenly positioned against one of first motorized roller 218 across the width of first edge 170. This protects against the possibility that first receiver 26*a* will be skewed relative to second receiver 26*b* during the overlap.

The example shown in FIGS. 5B-5F, illustrates one way in which a first edge of first receiver can be joined to a second edge of a second receiver.

Alternatively, in another embodiment printer 20 can be adapted to use overlap positioning system 110 to form combination print 200 with a second edge 172 of first receiver 26*a* is overlapped with a first edge 190 of second receiver 26*b* to form a combination print 200.

Figure 5G:
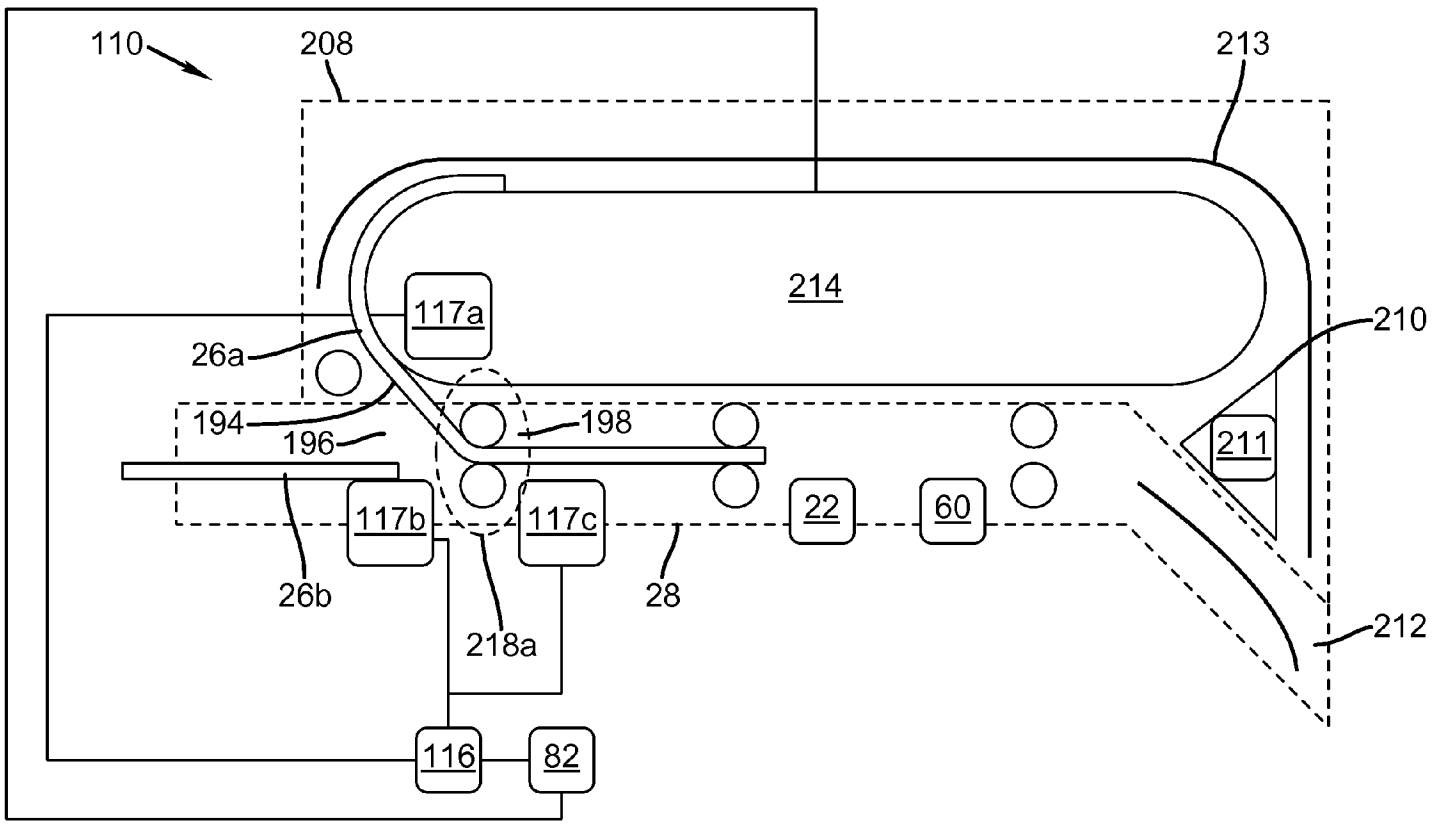
FIG. 5G shows another embodiment of an overlap positioning system.
Figure 5H:
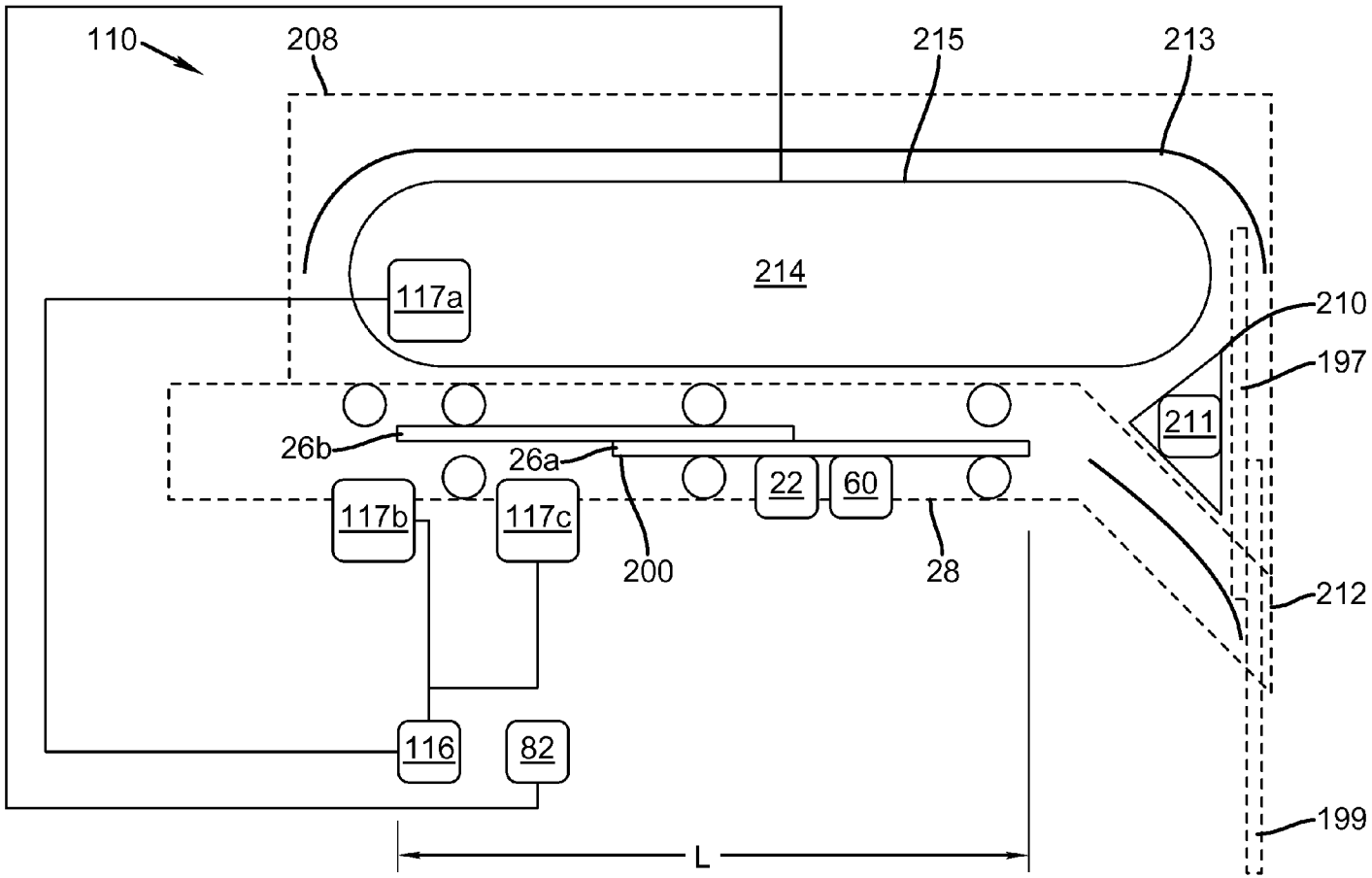
FIG. 5H shows another view of the embodiment of FIG. 5G.

FIGS. 5G and 5H show an overlap positioning system 110 that operates generally in the same fashion the embodiment shown in FIGS. 5B-5F. However, in this embodiment, position sensing system 116 has at least one sensor 117 that can detect when second receiver 26*b* reaches staging position 196 in receiver transport system 28. In this embodiment, printer controller 82 causes second receiver 26*b* to reach reentry point 198 at the nip between first motorized rollers 218*a* before advancing second receiver 26*b* from a staging position 196 and causes first motorized rollers 218*a* to move first receiver 26*a* past reentry point 198.

In this embodiment, position sensing system 116 provides at least one sensor that can sense conditions in receiver transport system 28 and from which it can be determined when second receiver 26*b* is positioned where second receiver 26*b* can be moved to a staging position 196 from which second receiver 26*b* can be moved to the reentry point 198 within a predetermined time and from which the extent to which a portion of first receiver 26*a* will have moved past the reentry position 198 after the predetermined period of time can be determined. In the embodiment of FIGS. 5G-5H position sensing system 116 provides a first sensor 117*a* that detects when a leading edge of first receiver 26*a* is positioned at staging position 194 and a second sensor 117*b* that detects when second receiver 26*b* reaches the reentry point and a third sensor 117*c* that monitors an amount of rotation of first motorized rollers 218*a* to determine an amount of a receiver that has moved past first motorized rollers 218*a*.

In other embodiments position sensing system 116 can use other arrangements of sensors 117 to generate signals from which printer controller 82 can determine such information or equivalents of such information. Position sensing system 116 can include any type of sensor 117 that can sense a receiver, or measure conditions indicative of movement of a receiver, or sense conditions from which a position of a receiver or amount of movement of a receiver can be determined and can comprise without limitation an optical, mechanical, electrical, electro-magnetic sensors, for example and without limitation.

Printer controller 82 uses the signals from position sensing system 116 to, measure, calculate or otherwise determine when first receiver 26*a* is located at a position where second 26*b* can be moved from the staging position 196 to reentry point 198 to cause first receiver 26*a* and second receiver 26*b* to be positioned with an amount of overlap required to form in the identified overlapping arrangement.

As shown in FIG. 5 printer controller 82 then causes first motorized rollers 218*a* to begin advancing first receiver 26*a* and second receiver 26*b* past first motorized rollers 218*a* at a rate appropriate for printing and fusing operations to be performed with first receiver 26*a* and second receiver 26*b* in the identified arrangement.

Printer controller 82 and position sensing system 116 can determine the amount of overlap in a variety of ways. For example, in one embodiment, the amount of overlap is established based upon receiver position sensing system that are positioned to sense movement of the first receiver 26*a* past a fixed point and movement of second edge 192 of second receiver 26*b* to the fixed point.

In another embodiment, the amount of overlap is determined by sensors 117 that can sense the position or movement of a first receiver 26*a* to a fixed point and that can further measure movement of the second receiver 26*b* to a position relative to the fixed point.

In still another embodiment, that can be used the amount of the overlap can be determined by use of a position sensing system 116 that captures electronic images of the overlapping first receiver 26*a* and second receiver 26*b* while printer controller 82 cooperates with overlap positioning system 110 to increase the extent of the overlap. In such an embodiment, printer controller 82 monitors the signals from the position sensing system 116 and increases the amount of the overlap until the amount of the overlap is sufficient to form determined image 140.

In still another embodiment, the amount of the overlap is established by positioning first receiver 26*a* and the second receiver 26*b* in a minimal overlap position, and using position sensing system 116 to sense a distance between a first edge 190 of second receiver 26*b* and second edge 172 of first receiver 26*a*. Where this is done, printer controller 82 cooperates with overlap positioning system 110 and receiver transport system 28 to adjust the relative positions of first receiver 26*a* and second receiver 26*b* to reduce a distance between first edge 190 and second edge 172 to the determined receiver length L. Other known techniques can be used to define the extent of the overlap.

In further embodiments, the amount of the overlap can be established by providing fiducial markings or other types of machine detectable fiducial features deposits or structures, on either first receiver 26*a* or on second receiver 26*b* that can be detected by a position sensing system 116 using sensors 117 that are adapted to detect the fiducial markings and can generate signals that can be used by printer controller 82 to help ensure alignment of first print receiver 26*a* and second receiver 26*b* during the overlap process.

It will be understood that overlap positioning system 110 can be incorporated in a printer 20 or supplied as an add-on modular feature or upgraded for use with a printer 20. In a modular or add on embodiment, generally any functions ascribed to printer controller 82 herein can be performed by an optional control circuit or control system 225 shown in FIG. 5F. Optionally control system 225 can have communication circuit 227 that can communicate with printer controller 82 so that when printer controller 82 requests the printing of an image having a determined receiver length L that is not available in printer 20.

Figure 5I:
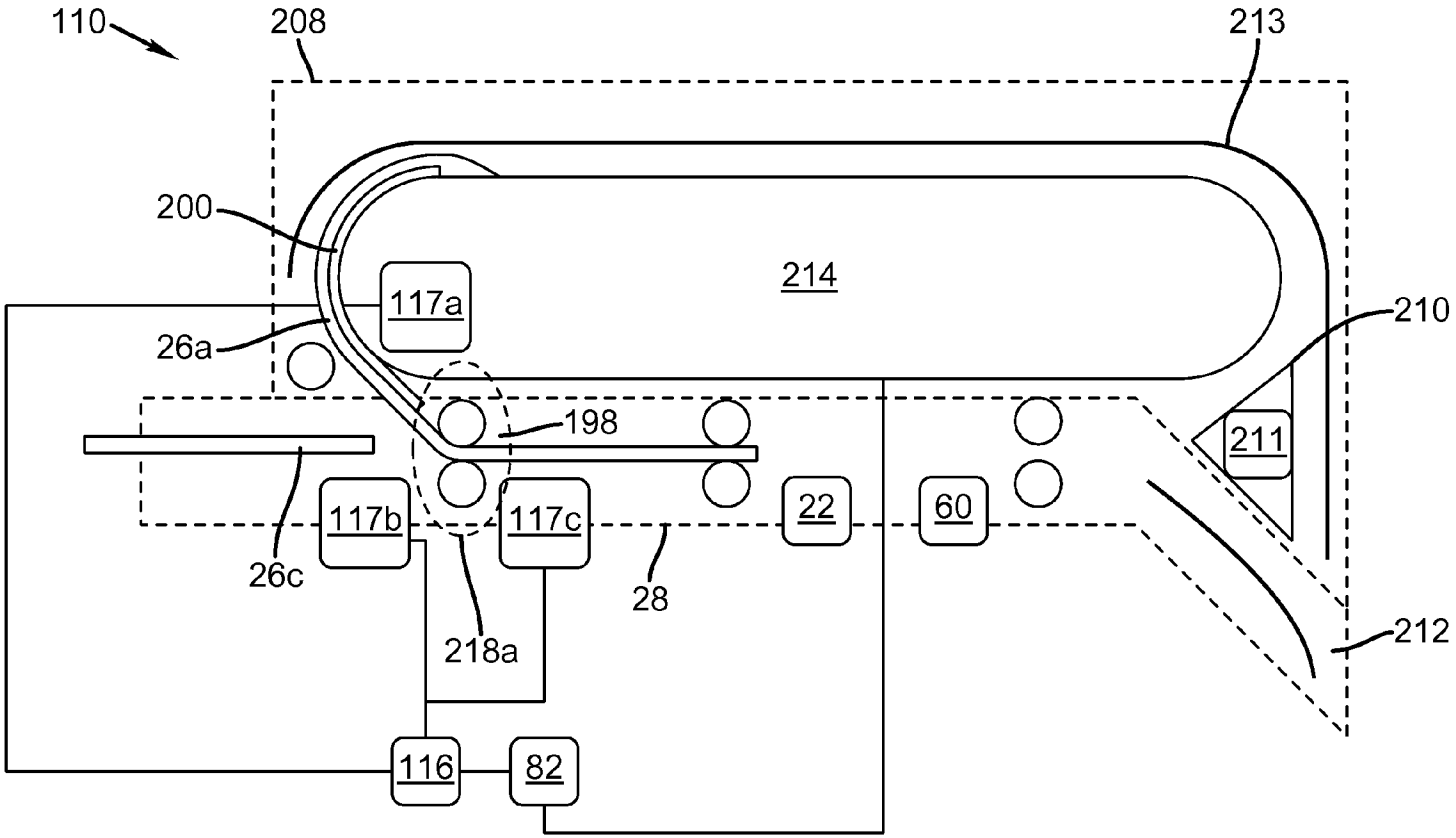
FIG. 5I illustrates the use of overlap positioning system to form a combination print using a continuous printing process.

Overlap positioning system 110 can be used for other purposes that can be of benefit in the further processing of a combination print 200. As is shown in FIG. 5I a combination print formed in a printer using recirculation system 208 can be guided by diverter 210 to reenter recirculation system 208 to allow a third receiver 26*c* to overlap a combination print 200 of type formed, for example, in FIG. 5D to join to an opposite end of first receiver 26*a* to further extend the length of combination print 200.

In this regard, it will be appreciated that using overlap positioning system 110 and an appropriate arrangement of sensors 117 of a position sensing system 116, printer 20 can form combination prints 200 with a first receiver having lead edge overlapped or a trailing edge overlapped or both. First toner image 26*a* will be adjusted accordingly to provide toner in an overlap area that is properly positioned to be overlapped at either first edge 170 or second edge 172.

Figure 5J:
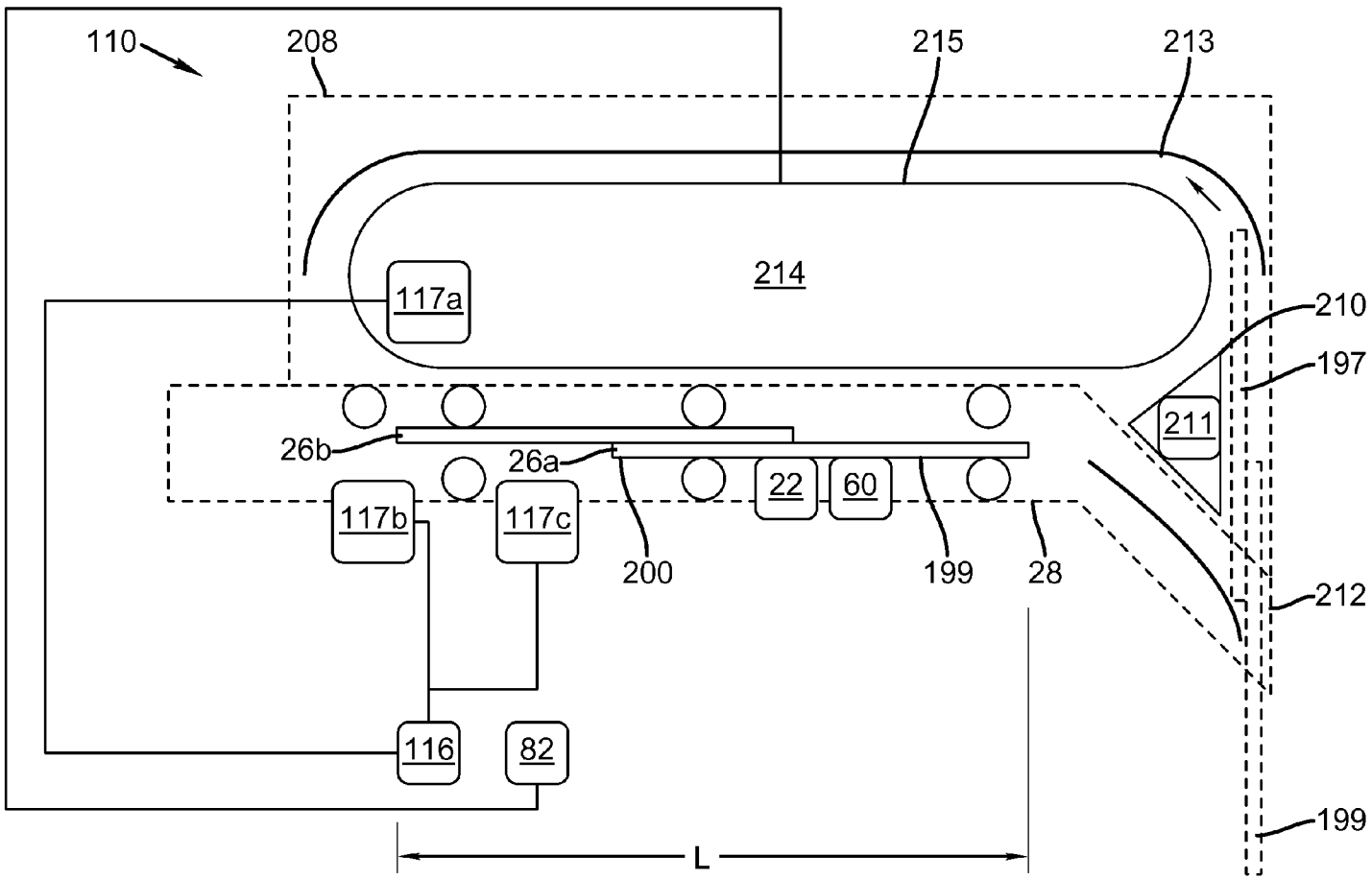
FIG. 5J illustrates another use an overlap positioning system to form a combination print using a continuous printing process.

As is shown in FIG. 5J a combination print 220 is formed in a printer 20 can be guided by diverter 210 to pass into post printing path 212 and to enter recirculation system 208 through a second pathway 197 (as shown in phantom) that presents an unprinted side 199 of combined print 200 to print engine 22 and fuser 60 when the combination print 220 is recirculated. This enables duplex printing on combination print 200 using recirculation system 208. As will be discussed in greater detail below, this also enables printing an image across the second side combination print 200 using a continuous image forming process.

Returning to FIG. 3, it will be observed that once that first receiver 26*a* and second receiver 26*b* are positioned in the identified overlapping arrangement, first receiver 26*a* and second receiver 26*b* are advanced through fuser 60 and fused (step 136). Fuser 60 fuses first toner image 25*a* to first receiver 26*a* and second toner image 25*b* to second receiver 26*b*. During such fusing (step 136) toner 24 that has been applied in overlap area 168 fuses first receiver 26*a* and second receiver 26*b* to bond first receiver 26*a* and second receiver 26*b* together to form combination print 200. As is also shown in FIG. 3, optional steps of adding additional receivers to combination print 200 (step 137) and duplex printing (step 138) can be performed. These optional steps can be performed in the manner that is described with reference to FIGS. 5B-5J to the extent that printer 20 incorporates one of the embodiments of offset positioning system 210 that are described therein. However, these steps can also be performed using a printer 20 having other types of overlap positioning systems 110 and to the extent that these are compatible with the handling of combination prints 200 having the determined receiver length L. For example, overlap positioning system 110 illustrated in FIG. 2 can also be used to cause second receiver 26*b* to overlap either first edge 170 of first receiver 26*a* or to cause second receiver 26*b* to overlap second edge 172 of first receiver 26*a* depending on the order of printing and the action of positioner 114.

Edge Protection Shield

Figure 6:
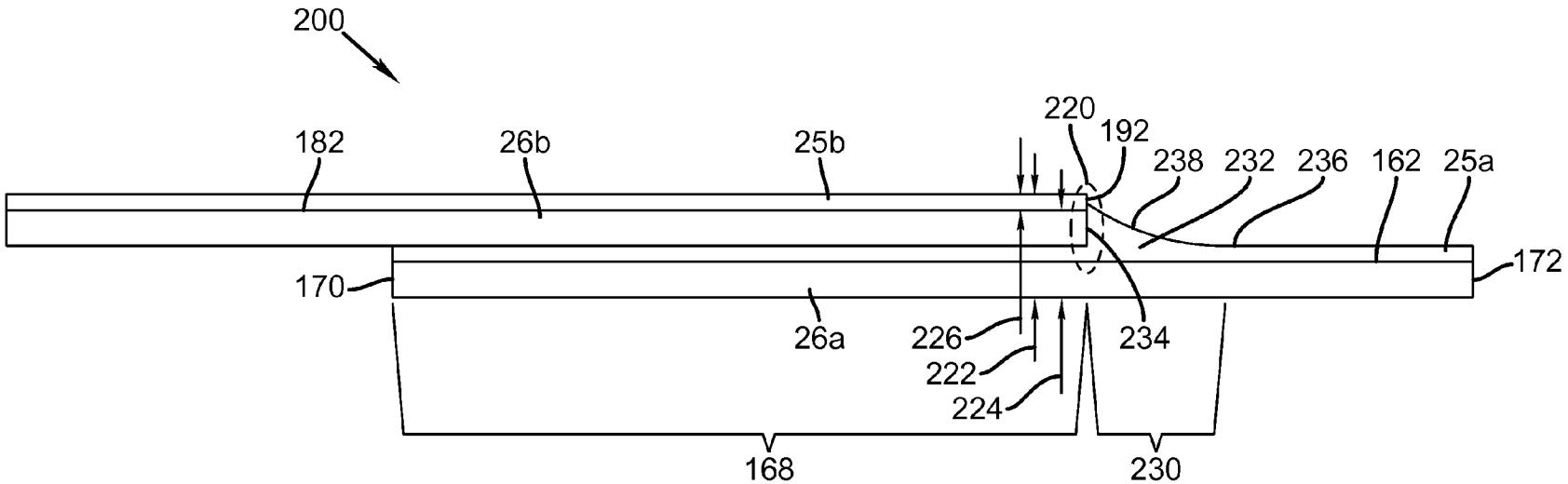
FIG. 6 shows a cross section view of a toner edge shield formed on the first print proximate an overlapping edge of a second print.

FIG. 6 shows a cross section of a portion of a fused combination print 200 having first receiver 26*a* and second receiver 26*b* with second edge 192 of second receiver 26*b* overlapping first receiver 26*a* from first edge 170 of first receiver 26*a* to an extent that is required to form to the determined arrangement of receivers.

As is illustrated in FIG. 6, an inter-print differential 220 is formed between a first side 182 of second print 180 and first side 162 of first print 160. Here inter-print differential 220 has a thickness 223 that includes a second thickness 224 of a second receiver 26*b* at second edge 192 and a toner thickness 226 of second toner image 25*b* applied at second edge 192.

As is noted above, inter-print differential 220 creates both an increased risk of providing a surface that can act as a mechanical catch for combination print 200 when a combination print 200 is moved through various passageways of a printer 20, finishing system 100 or elsewhere, and further provides visual artifact that can detract from the appearance of the combination print 200. It will be appreciated that such passageways are typically designed for the movement of a single thickness of receiver and therefore attempting to pass a combination print 200 which can be more than twice as thick as a thickness of a single sheet of receiver thickness can be exposed to a significant risk of damage.

Accordingly, as can be seen in FIGS. 4C and 4E first toner pattern 166 includes a toner edge shield 232 in inter-print toner area 230 with a first end 234 confronting second edge 192 and a second end 236 apart from first end 234. Toner 24 forming first toner image 25*a* at first end 234 extends to at least about 50% of the thickness 224 of second receiver 26*b* at second edge 192 after fusing. In certain embodiments this can be provided by providing a thickness 239 at first end 234 that is at least about 50% of the thickness 224 of the second receiver 26*b* at second edge 192 after toner 24 forming inter-print toner area 230 is fused.

Toner edge shield 232 further has a deflection surface 238 that is sloped from first end 234 to second end 236. deflection surface 238 is provided to reduce the likelihood that any structure might catch combination print 200 at second edge 192 by being positioned to confront such a structure before second edge 192 is moved past such a structure and is sloped to deflect combination print 200 away from such a structure by an extent sufficient to allow combination print 200 to pass such a structure without damage second edge 192. In certain embodiments deflection surface 238 can be monotonically declining from first end 234 to second end 236.

Figure 7:
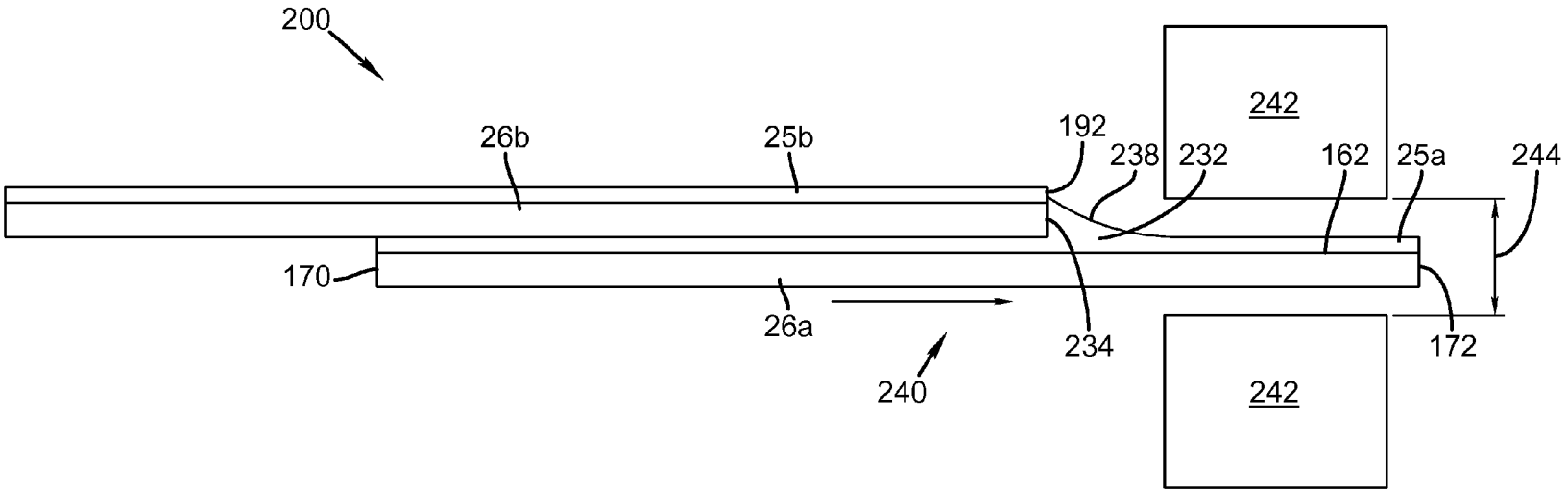
FIGS. 7, 8 and 9 illustrate one example of a way in which the toner edge shield can protect second edge during movement of the receiver.
Figure 8:
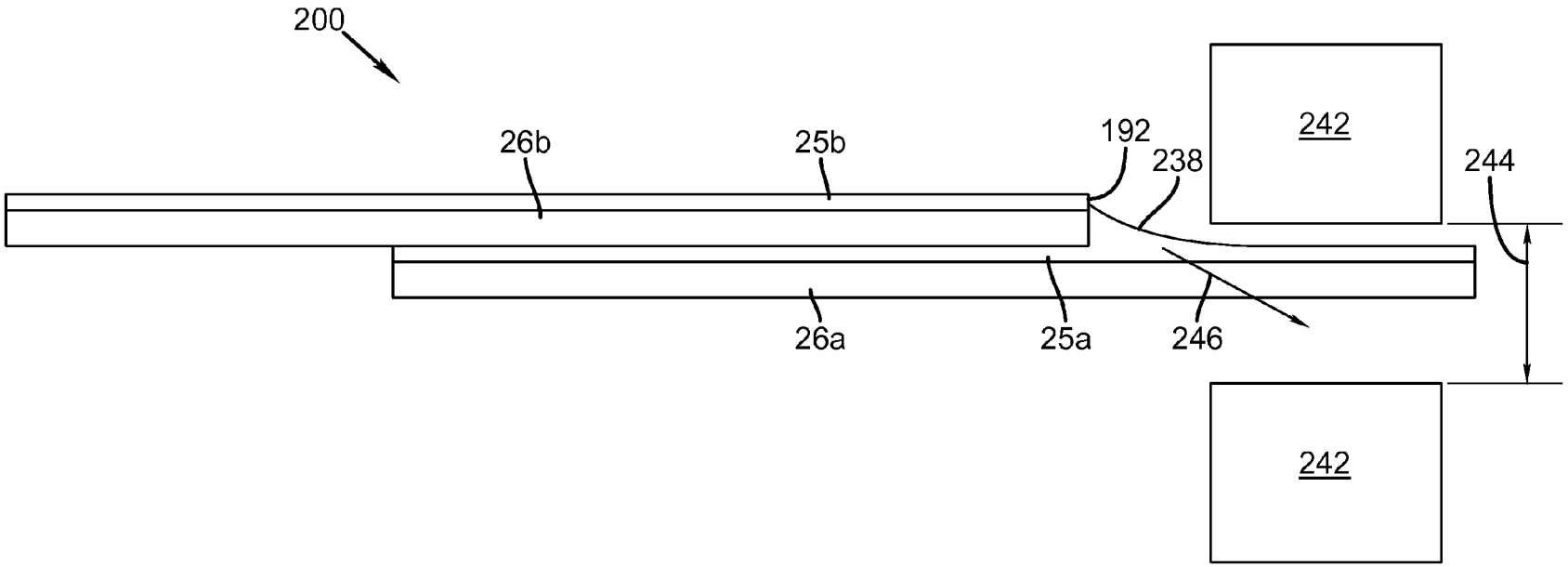
Figure 9:
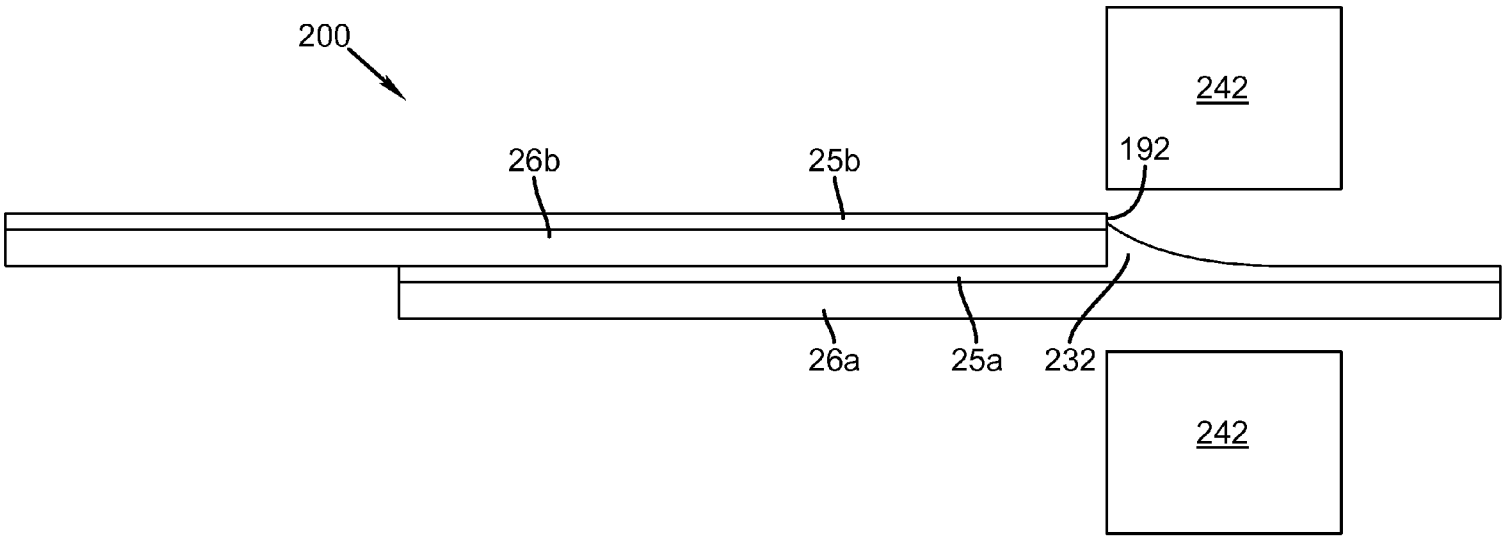

One effect of toner edge shield 232 is shown for example in FIGS. 7, 8, and 9. As is shown in FIG. 7, a printer 20 may have a receiver movement path 240 that requires combination print 200 to pass through an area 242 that only has a limited amount of clearance 244. However, as shown in FIG. 8, to the extent that a combination print 200 having toner edge shield 232 deviates from beyond the clearance 244 provided in area 242, sloped deflection surface 238 will contact area 242 before second edge 192. This imparts a vector displacement 246 to combination print 200 deflecting combination print 200 away from area 242 before second edge 192 of second print 180 contacts area 242 as shown in FIG. 9. In this way, the risk of damaging contact between second edge 192 and area 242 is avoided or minimized.

It will further be appreciated that in some embodiments, during fusing of first receiver 26*a* and second receiver 26*b*, first end 234 of toner edge shield 232 can fuse to a second edge 192 of second print 180 to provide additional binding between first print 160 and second print 180. In other embodiments, a separation can be provided between first end 234 of toner edge shield 232 and second edge 192.

In the embodiment of FIGS. 7, 8, and 9 the height of first end 234 of toner edge shield 232 confronting second edge 192 extends from about 50% of the thickness of second edge 192 and more in order to provide a sloped or tapered and can act as a deflection surface 238 that can provide a desired opportunity for deflection. Various techniques for forming toner piles having a particular height can be employed toward this end. In certain embodiments, use of clear toner 24, including toner having particle sizes that are greater than at least 20 um can also be advantageously applied to form toner stack heights that are in excess of about 50 um to 100 um or more. For example, in some instances such toner stack heights can be provided by applying multiple layers of toner, the use of foaming toners that expand during fusion or by using large sized toner particles to form the inter-print toner area 230. Such techniques can also be used in combination as desired.

Figure 10:
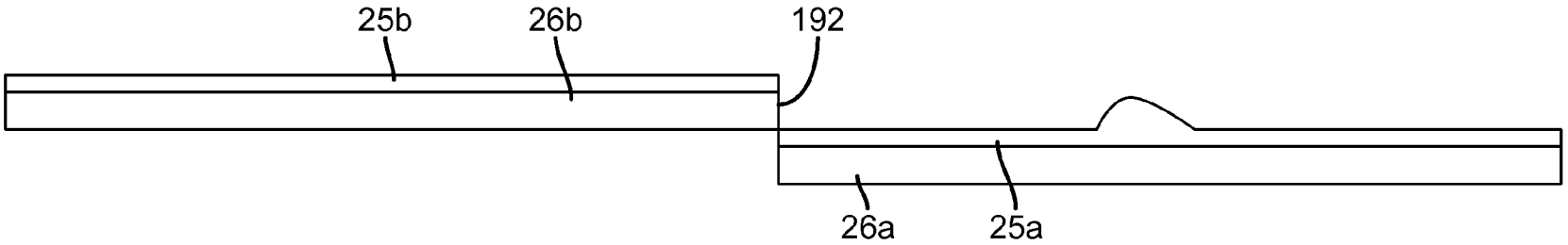
Figure 11:
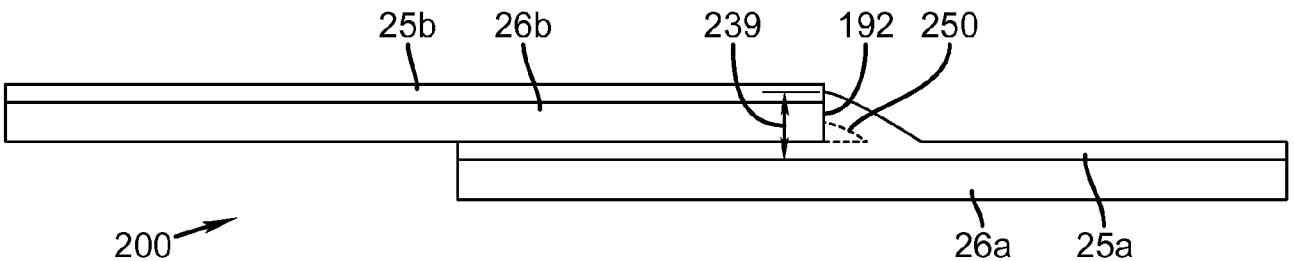
FIG. 11 shows another embodiment of a combination print 200 having a toner shield.

In one optional embodiment, the thickness of toner 24 at first end 234 of toner edge shield 232 can be built up in part by including amount of toner from overlap area 168 that builds up against the second receiver 26*b* as second receiver 26*b* is moved from a first overlapping position shown in FIG. 10, across first receiver 26*a* to a second overlapping position shown in FIG. 11, to provide a base toner layer 250 that supports toner 24 at first end 234 this can increase the thickness 239 or extent of the projection of first end 234 of toner edge shield 232. In other embodiments, the thickness of toner edge shield 232 at first end 234 can extend at least as for as the thickness of second receiver 24*b* at second edge 192.

Figure 12:
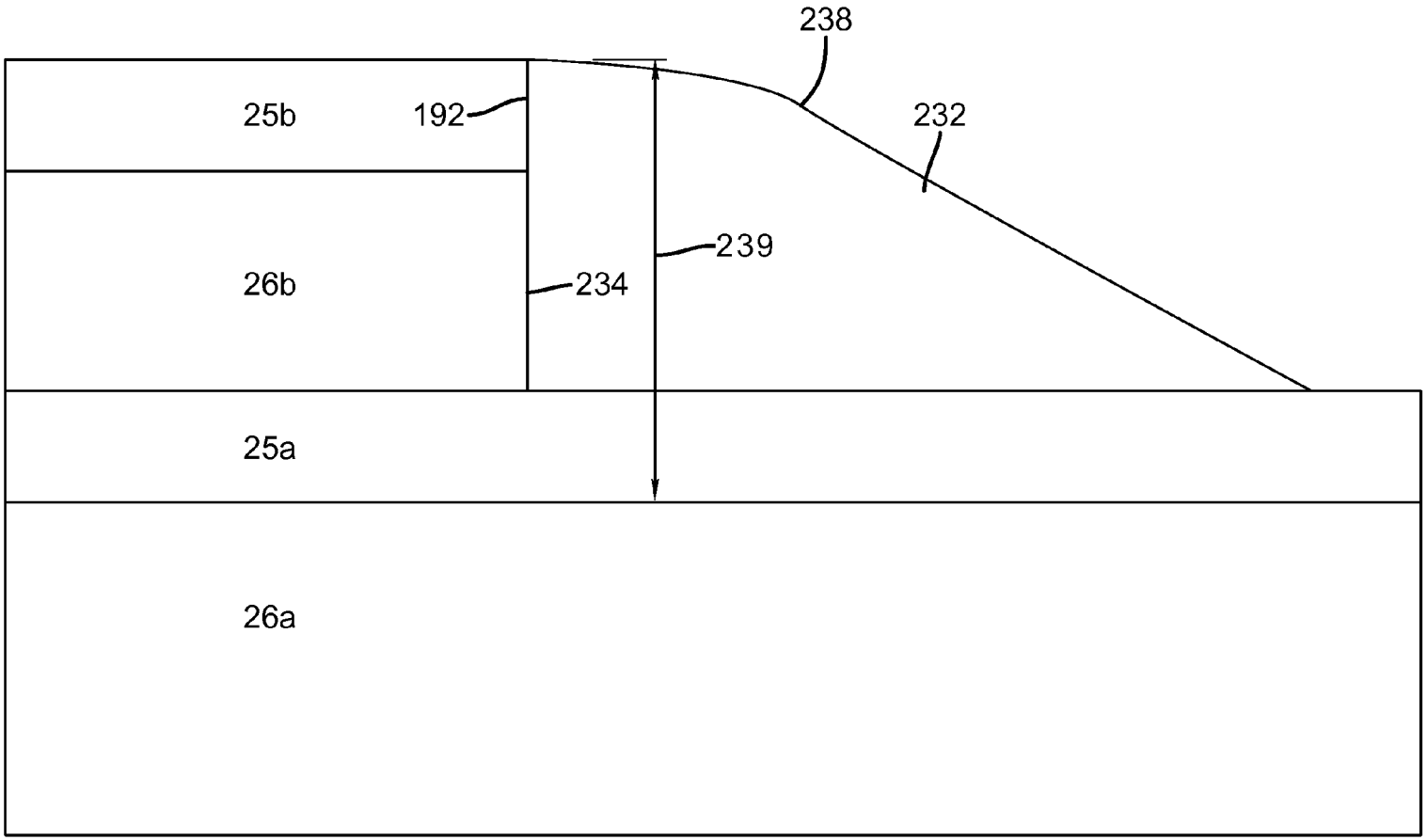
FIG. 12 shows still another embodiment of a combination print 200 having a toner shield.

FIG. 12 shows another embodiment of a combination print 200 having a toner edge shield 232. In this embodiment, first end 234 of toner edge shield 232 extends to a thickness of second edge 192 and the thickness of second toner image 25*b* at second edge 192. This forms a generally continuous toner layer from which deflection surface 238 extends on combination print 200 to further reduce the likelihood of mechanical damage to combination print 200. Such a continuous toner layer can provide additional strength to bond first receiver 26*a* to second receiver 26*b*.

Figure 13:
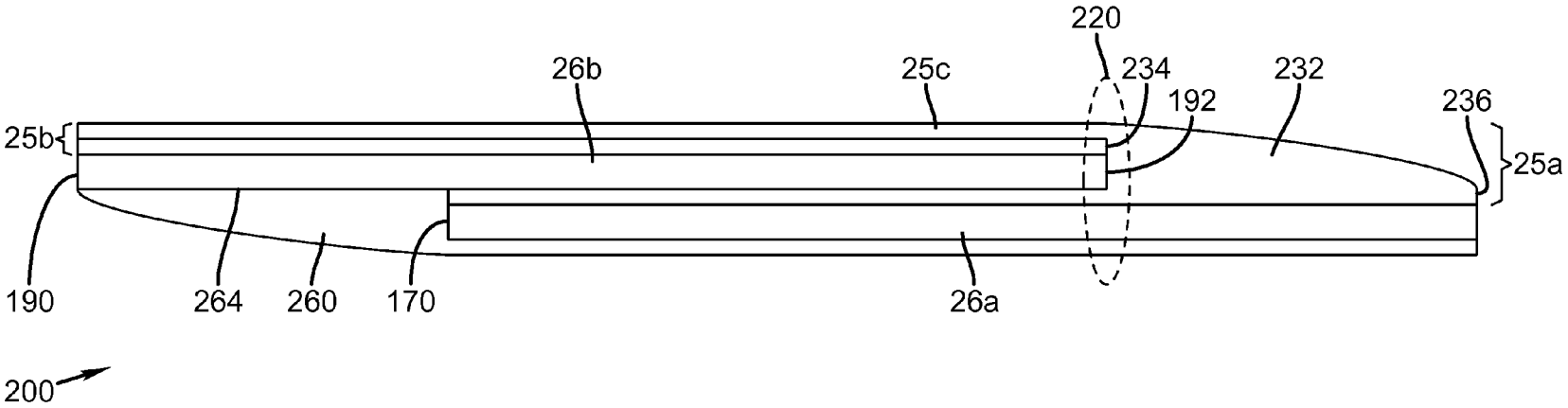
FIGS. 13 and 14 illustrate an embodiment where the first toner image is pre-fused or sintered before overlapping.

FIG. 13 shows still another embodiment of a combination print 200 having a toner edge shield 232. As is shown in this embodiment of toner edge shield 232 extends beyond the thickness of second receiver 26*b* at second edge 192. As is also shown in this embodiment, toner from first toner image 25*a* optionally forms a continuous fused toner layer 25*c* with toner from second toner image 25*b* formed on second receiver 24*b*. Also shown in this embodiment, toner edge shield 232 has a first end 234 that confronts second edge 192 of second receiver 26*b* and a second end 236 that is at second edge 172 of first receiver 26*a* such that deflection surface 238 is sloped from first end 234 to a second end 236 along a extended slope providing further opportunity for early and/or multiple deflective contacts between deflection surface 238 and a structure in a path of travel of combination print 200 to facilitate movement of combination print 200 without damage.

As is further shown in FIG. 13, combination print 200 has an optional second toner edge shield 260 formed on a second side 262 of first receiver 26*a* and a second side 264 of second receiver 26*b*, that optionally includes the optional features described in embodiment of FIG. 13 and that can provide similar protections for first edge 180 having a first thickness 181. It will be appreciated that a second toner edge shield 260 can be provided with or without such optional features and can also be provided in accordance with any other embodiment of toner edge shield 232 described herein.

Figure 14:
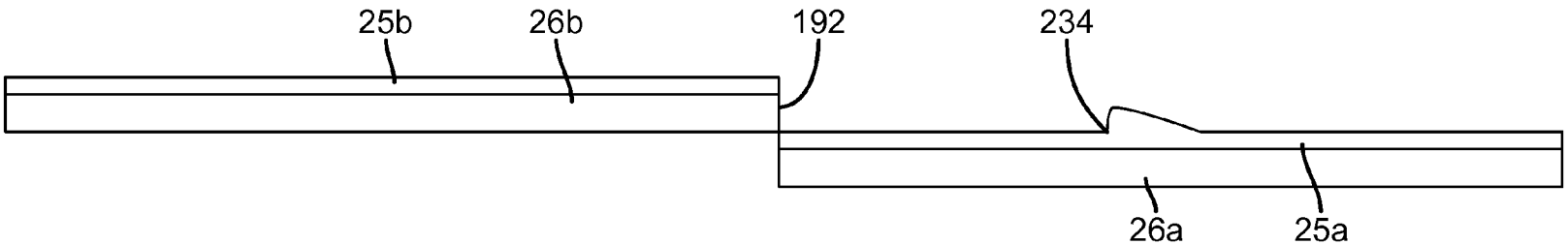
Figure 15:
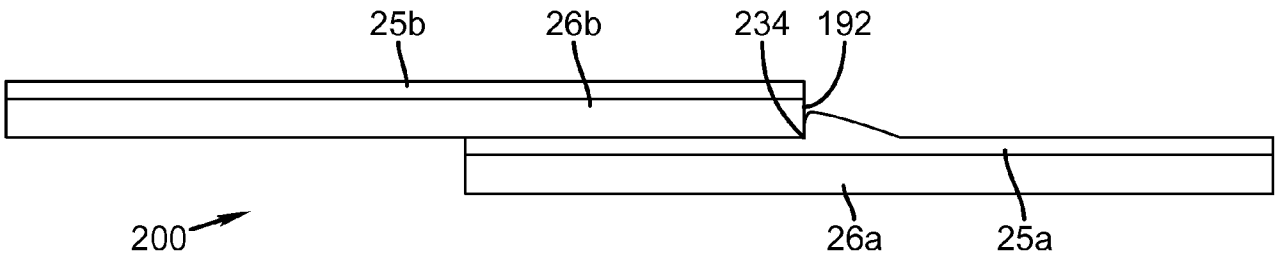
FIG. 15 illustrates yet another embodiment of a combination print.

It will be appreciated that the steps described herein are not limiting as to the order of overlapping and fusing. For example, in accordance with one embodiment, first toner image 25*a* is recorded on first receiver 26*a* and pre-fused or sintered thereto before overlapping first print 160 with second receiver 24*b* and before fusing. This can be done to allow, for example the printing of first print 160 to occur in a batch that is prepared before second receiver 26*b* is printed. As is shown in FIGS. 14 and 15, this can also be done can also be done to allow first end 234 to be formed and pre-fused as shown or sintered to make first end 234 generally rigid on first receiver 26*a* so that first end 234 can block movement of second edge 192 to position second edge 192 of second receiver 26*b* at a defined location during the overlapping.

Figure 16:
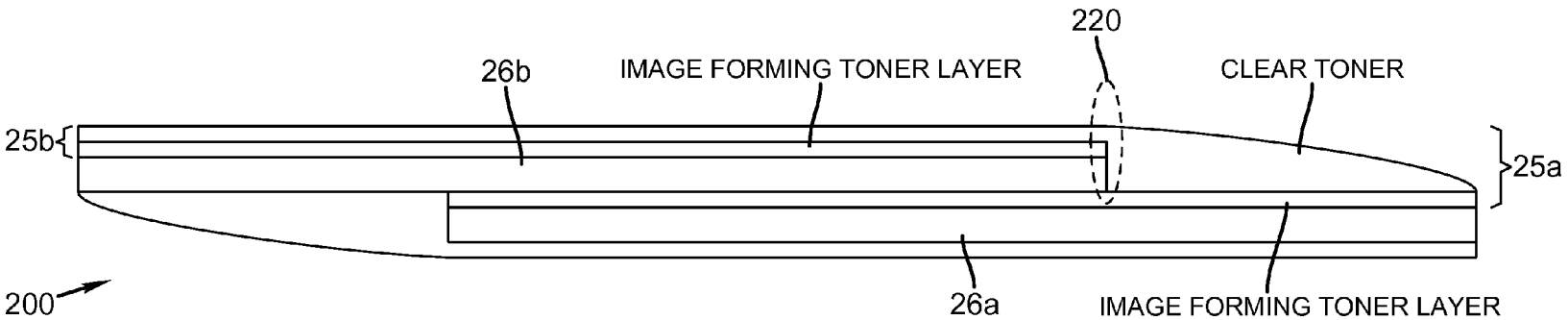
FIG. 16 illustrates yet another embodiment of a combination print.

FIG. 16 shows still another embodiment of a combination print 200 that can be formed. Here first print 160 is printed to have a first toner image 25*a* with an image forming layer in accordance with the first toner image 25*a* and is then overlapped with second receiver 26*b*. First print 160 and second receiver 26*b* are then passed through print engine 22 for additional printing, for example and without limitation, this can be done using a recirculation system 208 of the type discussed above. In this embodiment, a clear layer of toner 24 is applied to first print 160 to cooperate with the image forming layers to form a first toner image 25*a* including toner edge shield 232 and both image forming and clear toner are to form a second toner layer and image layer and a toner layer on second receiver 26*b* in accordance with a second toner pattern. As is shown in this embodiment, the clear layer on first receiver 26*a* and the clear layer on the second receiver 26*b* form a continuous clear toner layer across combination print 200.

Figure 17:
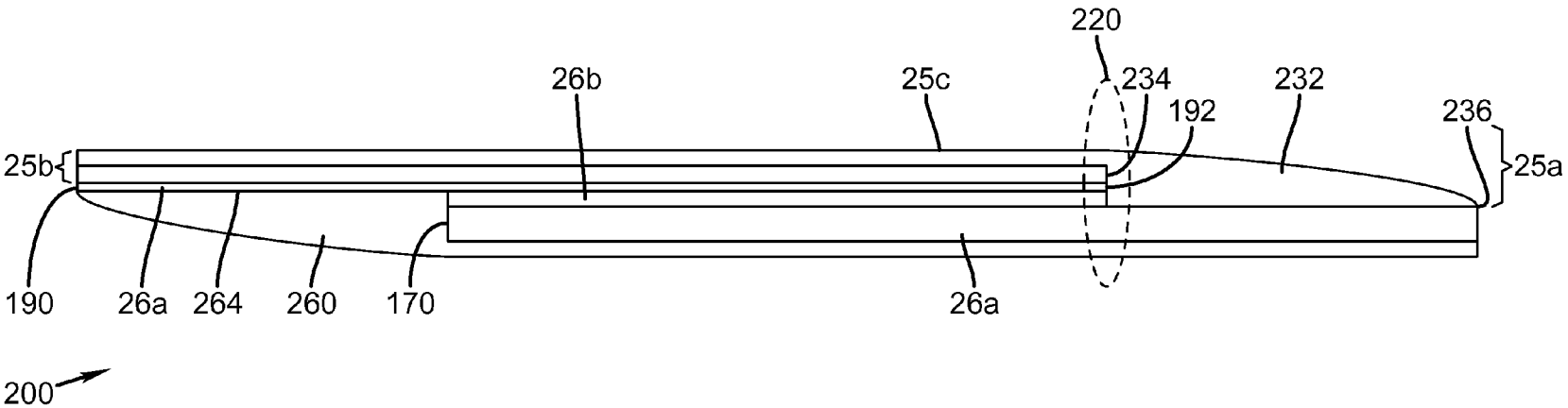
FIG. 17 illustrates yet another embodiment of a combination print.

It will be appreciated that in multi-color printing it is often possible to form individual picture elements of a particular color using more than one combination of colored toners. It will also be appreciated that different combinations of colored toners will typically have different toner thicknesses. Using, for example and without limitation, a processes known to those of skill in the art as under color removal, the numbers of color used to represent a color in an image can be reduced, for example, by substituting black toner for a combination of other colors that will appear to be black. When such a process is used the average amount of toner used to form an image can be reduced as can the thicknesses of toner used to form an image. When such a process is not used toner thicknesses can be larger. Accordingly, in certain embodiments, under color removal or other techniques know to those of skill in the art for forming colors can be used to minimize toner thicknesses in portions of second toner image 25*b* formed at second edge 192 of second receiver 26*b*. Optionally, such techniques can be applied to any image forming toner at second edge 172 of first receiver 26*a* or at first edge 190 of second receiver so as to provide combination print 200 leading or trailing edges having a thickness that more closely approximates conventional required thicknesses FIG. 17 shows another optional embodiment of combination print 200 of the type illustrated in FIG. 13 above. However, in this embodiment, printer controller 82 automatically selects at least one of the receivers to have a thickness that is less than a thickness of the receiver to which the selected receiver is bound. Here, second receiver 26*b* has been selected to be substantially less thick than first receiver 26*a* to minimize the extent of the inter-print differential 220. It will be appreciated that this allows printer controller 82 to reduce the overall cross section of the receiver. As is shown in this figure, a second toner edge shield 260 can be provided in a similar mariner to that discussed in FIG. 13 and has the additional advantage of supplying additional toner 24 to compensate for any differences in receiver strength occasioned by the use of such a thinner receiver. It will be appreciated that in certain embodiments printer controller 82 can select both of first receiver 26*a* and second receiver 26*b* in the manner that is described herein.

In certain embodiments, it may be necessary or advantageous to perform printing of only one of first receiver or second receiver during the process of forming a combination print 200. For example, either of first receiver 26*a* or second receiver 26*b* can be printed using a separate or separable printer, or can be printed on printer 20 and stored as discussed above.

Figure 18:
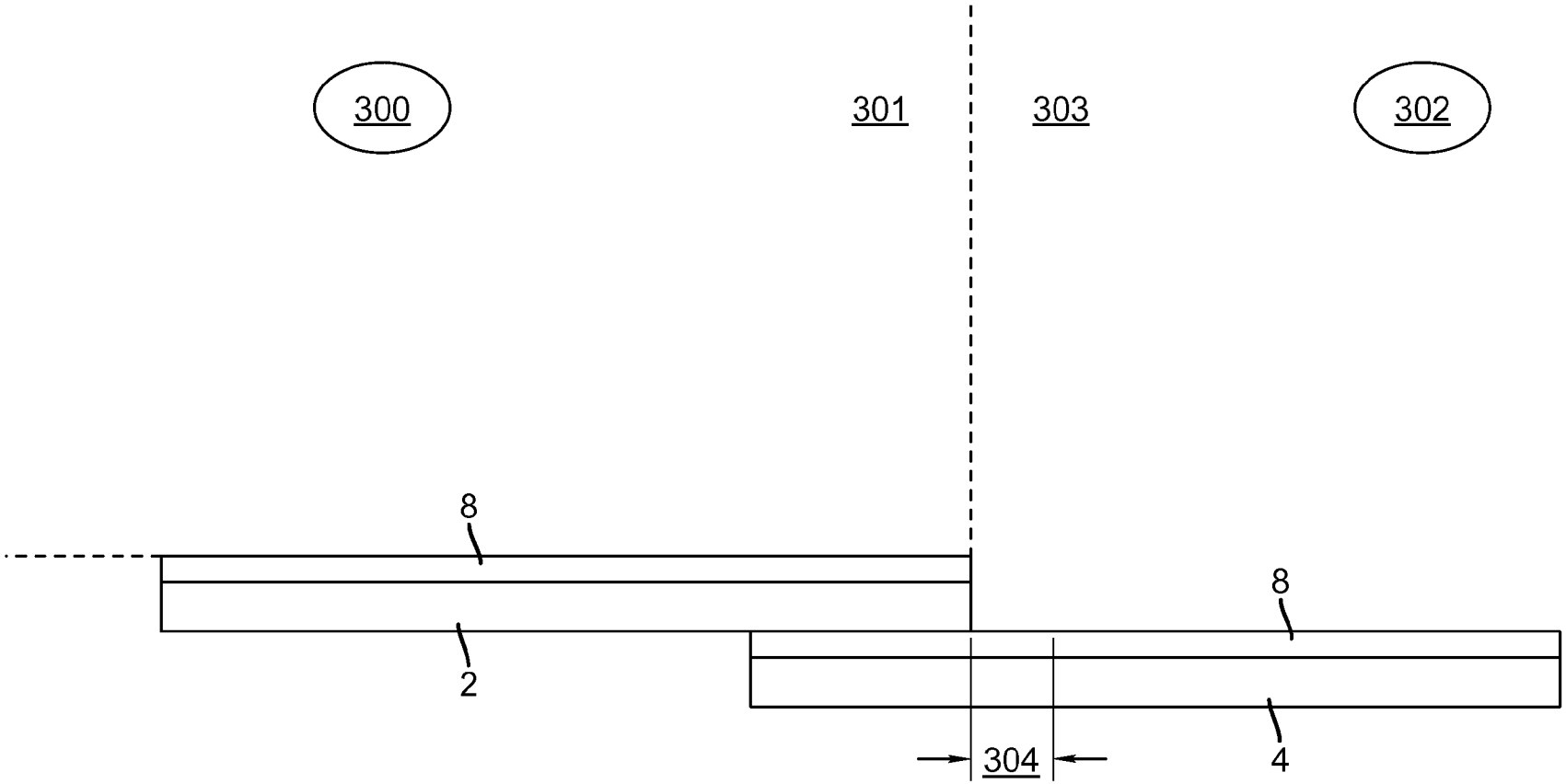
FIG. 18 PRIOR ART
FIG. 18 illustrates the ways in which the edge bound sheets of the prior art create image artifacts.

FIG. 18 shows one embodiment of a method that can be performed by printer controller 82 and printer 20 to cause printing In such circumstances, it can be possible for printer 20 to receive instructions from such other printer or form another type of external device 92 that enables printer 20 to provide the necessary overlap and to print the remaining image. In which case, the step of providing either of first toner image and to receive a toner image or information from which a toner image can be determined for printing on the remaining image. It will be appreciated, that the method of claim 18 can be used in other circumstances.

Figure 19:
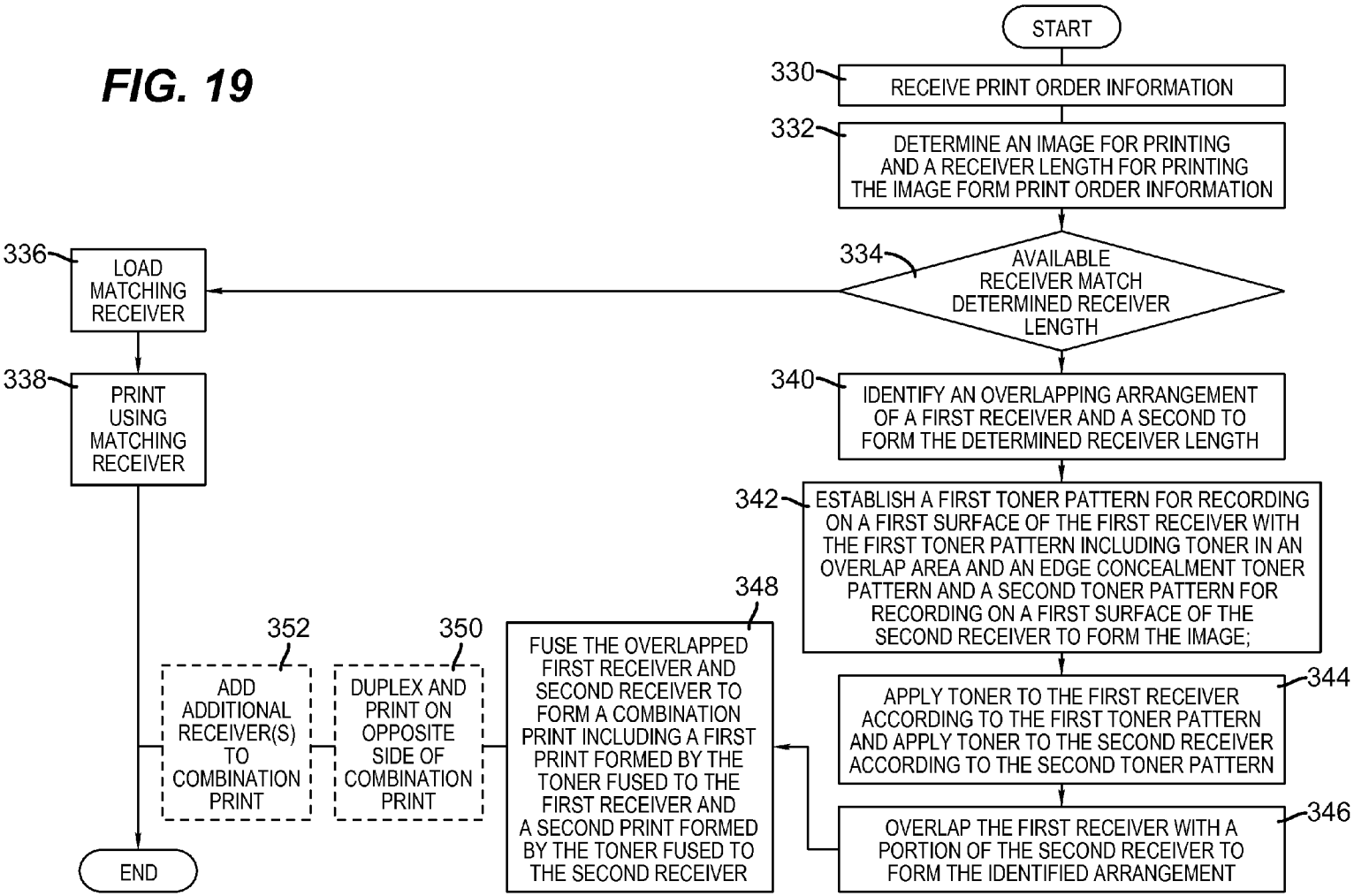
FIG. 19 shows a method for forming a combination print having a pleasing appearance.

FIG. 19 shows another embodiment of a printer 20 of the type illustrated in FIG. 1, with overlap positioning system 110 positioned in another location relative to print engine 22. As is shown in FIG. 19, in this embodiment, first receiver 26*a* is formed having toner 24 at least in an overlap area and is fused, but is then recirculated to a position proximate to a receiver supply 32 from which a second receiver 26*b* can be provided in an overlapping fashion and then positioned relative to recirculated first receiver 26*a*, first receiver 26*a* and second receiver 26*b* can then be positioned in an overlapping manner using overlap positioning system 110 and passed through print engine 22 a second time.

It will be appreciated that in this example, as in the embodiments illustrated in FIGS. 5D and 5H, print engine 22 can be operated to record a determined image on both of first receiver 26*a* and second receiver 26*b* using a single continuous image forming process. That is print engine 22 can record image information on the overlapped first receiver and second receiver as if they form a single sheet of receiver. Accordingly, images do not require portioning as described above and the risk that an image printed on a combination print will have discontinuities caused by minor variations in overlap are greatly diminished. In that there is no risk that image content recoded on the first print will be lost to alignment variations at the overlap. Instead, here any such variability will be visible only at the edges of the combination print and therefore can be addressed by masking or mounting.

Figure 20:
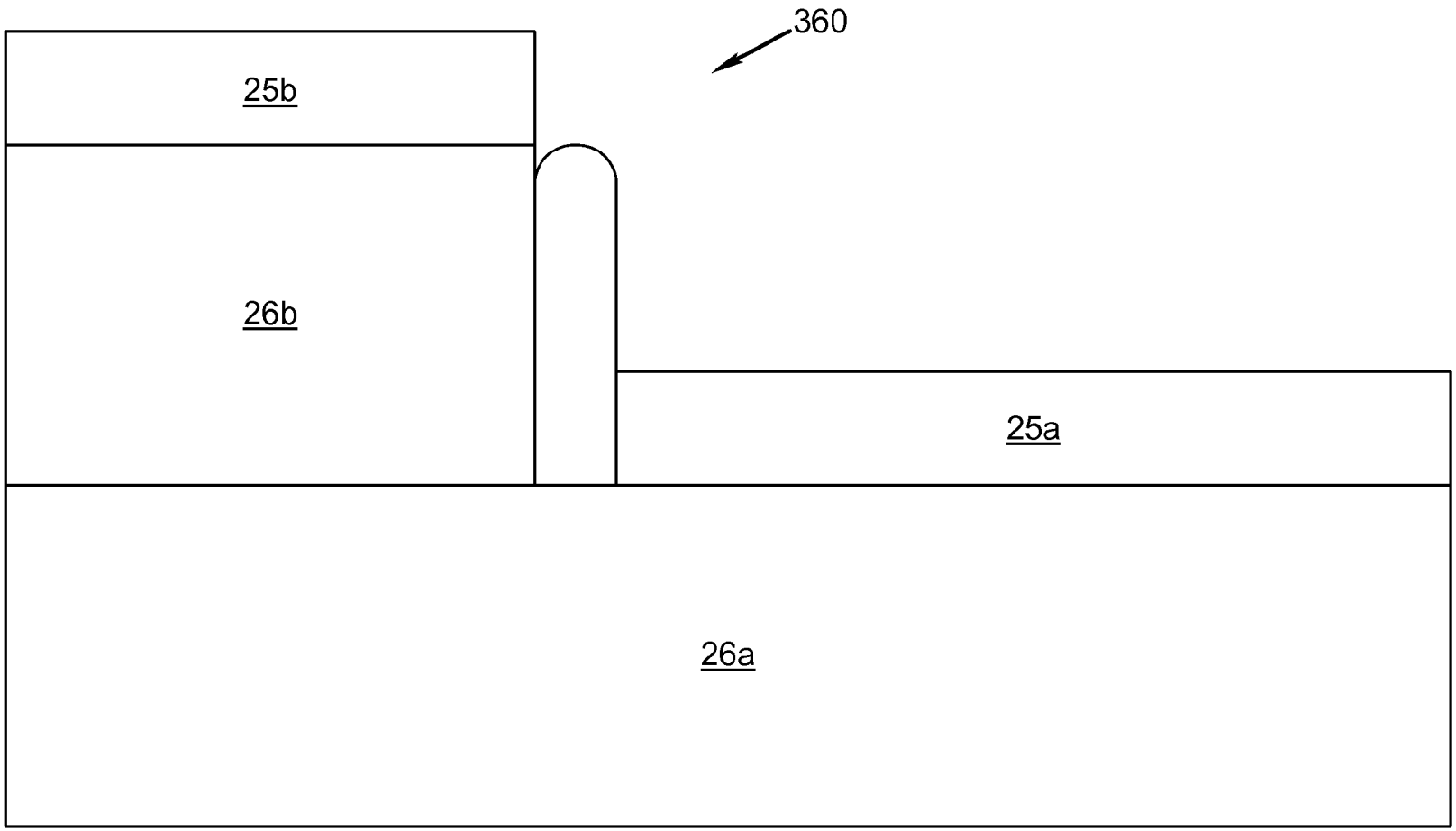
FIG. 20 shows a first embodiment of an edge concealment toner pattern.

It will further be appreciated that where the determined image is printed on first receiver 26*a* when first receiver 26*a* is overlapped by second receiver 26*b*, the non-overlapped portion of the first receiver 26*a* can optionally have a base toner image applied in non-overlapped portion of first receiver 26*a* which will be overprinted during the printing of determined image 140. Accordingly, as is shown in the example of FIG. 20, this base toner layer can be used for a variety of purposes including increasing the extent to which a toner edge shield toner or a toner edge concealment pattern extends from the first side of first receiver, or for other purposes such as otherwise enhancing gloss, reflectivity, material strength or other characteristics of first receiver 26*b*.

Edge Concealment Toner Pattern

Figure 1A:
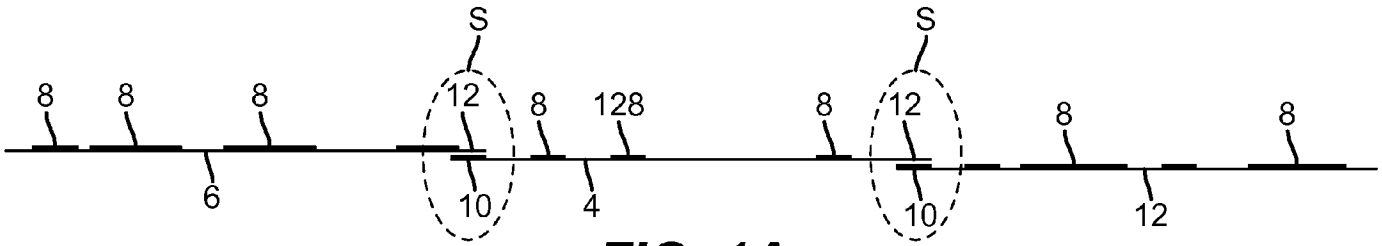
FIG. 1A PRIOR ART
FIGS. 1A, 1B and 1C show various embodiments of prior art that provides bound sheets.
Figure 1B:
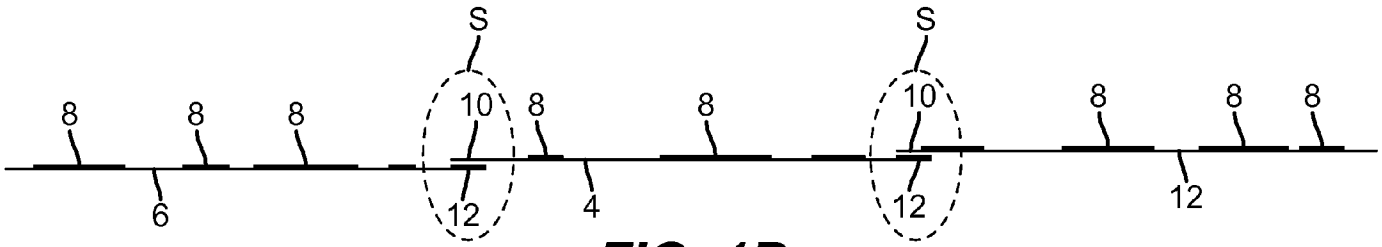
FIG. 1B PRIOR ART
Figure 1C:
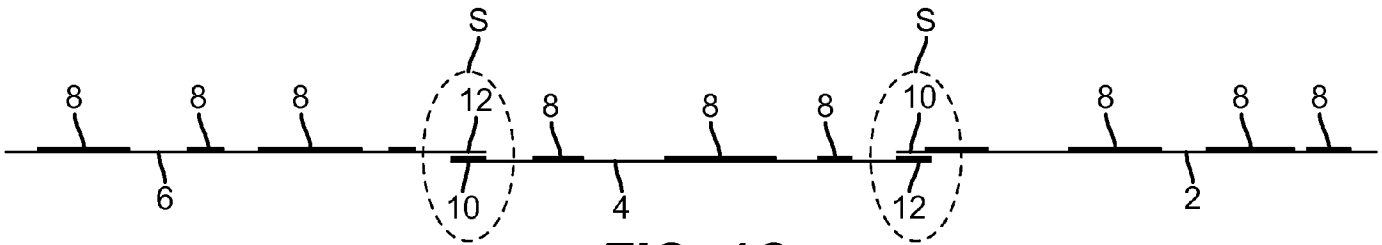
FIG. 1C PRIOR ART

As discussed previously, the combined sheets of the prior art shown in FIGS. 1A, 1B and 1C have visible artifacts at each step S. FIGS. 18A and 18B show these conditions in greater detail. As is shown in FIG. 18A, a viewer at a first viewing position 300 observes light that has been reflected by a leading sheet 2 that overlaps a following sheet 4. However, light from portion 304 of leading sheet 2 is blocked by either leading sheet 2 or toner 8 on leading sheet 2. This creates an image discontinuity by effectively masking the image content from portion 304 of following sheet 4 from the perspective of a viewer at a first viewing position 300. Accordingly, from the perspective of a viewer at first viewing position 300, combination print 200 has an appearance that has a discontinuity problem.

As is also shown in FIG. 18, a viewer at a second viewing position 302 observes light that has been reflected by leading sheet 2 and following sheet 4. The viewer also sees light that is reflected by an edge 7 of leading sheet 2. Edge 7 is unprinted and therefore creates a visible line across the joined sheets 2 and 4 that has a coloration that is reflective of the material that forms first receiver 26*a* or second receiver 26*b*.

Accordingly, what is needed is a method and a printer for forming a combination print 200 that has an appearance that is acceptable to viewers across a range of viewing positions.

FIG. 19 shows a first embodiment of a method for using a printer to form an aesthetically pleasing combination print 200. In this embodiment, a print order is received including information from which an image and a receiver length for printing the image can be determined (step 330) and printer controller 82 determines an image and a receiver length for printing the image based upon the received print order (step 332).

Printer controller 82 then determines whether printer 20 has a receiver 26 available for printing having a length that matches the determined receiver length L (step 334). Where printer controller 82 determines that there is such a receiver 26 available for printing, printer controller 82 can cause, for example, receiver supply 32 to supply such receiver 26 for use in printing or can activate manual loading processes that enable a user to load receiver 26 of the matching length onto receiver transport system 28 (step 336). The determined image is then printed on the matching receiver (step 338). It will be appreciated that steps 334-338 are optional and that in this regard printer controller 82 can be instructed to form an image on two joined receivers and can do so without making such a determination. Such instruction can be provided in the print order, in signals received from external devices 92 or by way of user input system 84.

Printer controller 82 then identifies an overlapped arrangement of a first receiver and a second receiver that can be overlapped to form the determined receiver length (step 340). These steps can be performed in the manner and using the structures and mechanisms that are described above with respect to steps 126-138 respectively in FIG. 3.

Printer controller 82 establishes a first toner pattern to form a first portion of the image on a first surface of the first receiver and a second toner pattern to form a second portion of the image on a second surface of the second receiver positioned so that when the first receiver is overlapped by the second receiver to form the determined combination, the overlapped combination forms the determined image (step 336). The first toner pattern toner provides toner in an overlap area and an image forming area to forms a portion of the determined image as generally described above with reference to FIG. 3. Further, printer controller 82 causes first toner pattern to include an edge concealment toner pattern 360 conceals, masks, or otherwise reduces in any way the visual impact of image artifacts that are created by overlapping second edge 192—either or both of the image discontinuity caused by the blocking of a non-overlapped a portion of first toner image 25*a* or caused by an exposed second edge 192.

Printer controller 82 then causes print engine 22 to apply first toner image 25*a* to first receiver 26*a* according to the first toner pattern and to apply a second toner image 24*b* to the second receiver according to second toner pattern (step 338) overlap positioning system 22 to cooperate with receiver transport system 28 to overlap a portion of first receiver 26*a* with a portion of the second receiver 26*b* to form the identified combination (step 340); and, causes fuser 60 to fuse the overlapped first receiver 26*a* and second receiver 26*b* (step 342). Printer controller 82 then causes the first toner pattern to be formed such that the first toner pattern further provides toner on an overlapped portion of the first receiver such that fusing the overlapped first receiver and second receiver causes the toner in the overlapped portion to bind the first receiver to the second receiver (step 344). Steps 338-344 can be performed in the manner and using the structures and mechanisms that are described above with respect to steps 126-138 respectively in FIG. 3.

However, as is also shown in the embodiment of FIG. 19, printer controller 82 further establishes first toner pattern such that the first toner pattern further provides an edge concealment toner pattern having a first end confronting second edge of the second receiver with said edge concealing toner pattern creating conditions proximate second edge 192 that reduce the visual impact of artifacts created by second edge 192 such as by reducing the ability of a observer to detect discontinuities created by the overlap of the second edge over the first receiver. The edge concealment toner pattern will be discussed in greater detail below.

Printer controller 82 further cooperates with receiver transport system 28, overlap positioning system 110 and fuser 60 to apply toner to the first receiver according to the first toner pattern, to apply and to apply toner to according to the second toner pattern to the second receiver 26*b* (step 346), to overlap first edge 170 of first receiver 26*a* with a second edge 172 of second receiver 26*b* to form the identified arrangement (step 348) and to fuse the overlapped first receiver 26*a* and second receiver 26*b* to form a combination print 200 including a first print formed by the toner fused to the first receiver and a second print formed by the toner fused to the second receiver (step 350). Optionally, the combination print can be recirculated to allow an additional sheet to be added thereto or recirculated for duplex printing on a second side. Steps 344-354 can also be performed in the manner and using the structures and mechanisms that are described above with respect to steps 126-138 respectively in FIG. 3.

FIG. 20 shows a first embodiment of an edge concealment toner pattern 360. As is shown in this embodiment, edge concealment toner pattern 360 is positioned along second edge 192 to mask second edge 192 or a portion of second edge of 192 of second receiver 26*b* in order to block or to modulate light reaching or reflected by second edge 192.

In the embodiment that is illustrated, toner 24 from first toner image 25*a* is provided and extends from first receiver 26*a* to an extent that provides stack heights that are sufficient to cover a portion of second edge 192 sufficient mask second edge 192. The coverage of second edge 192 by masking toner 362 can be complete or partial as desired to achieve a desired extent of concealment of second edge 192.

Various techniques for forming toner piles having a particular height can be employed toward this end. In certain embodiments, use of clear toner 24, including toner having particle sizes that are greater than at least 20 um can also be advantageously applied to form toner stack heights that are in excess of about 50 um to 100 um or more. Further, in some embodiments such toner stack heights can be provided by applying multiple layers of toner, the use of foaming toners that expand during fusion as is known in the art or by using large sized toner particles to form at least a part of toner edge shield 232 as is also known generally in the art.

In this regard, where print engine 22 is capable of recording image elements forming first toner image 25*a* or second toner image 25*b* using different combinations of toner 24 having different thicknesses, for example, where printer 20 can form the same image content using, for example, under color removal techniques, printer controller 82 can for example suspend the application of under color removal techniques proximate to second edge 192 to secure greater toner stack heights or printer controller 82 can cause print engine 22 to record a portion of first toner image 26*a* proximate second edge 192 using combinations of toner that have greater thickness than other combinations of toner that can be used.

Such techniques can also be used in combination as desired.

Figure 21:
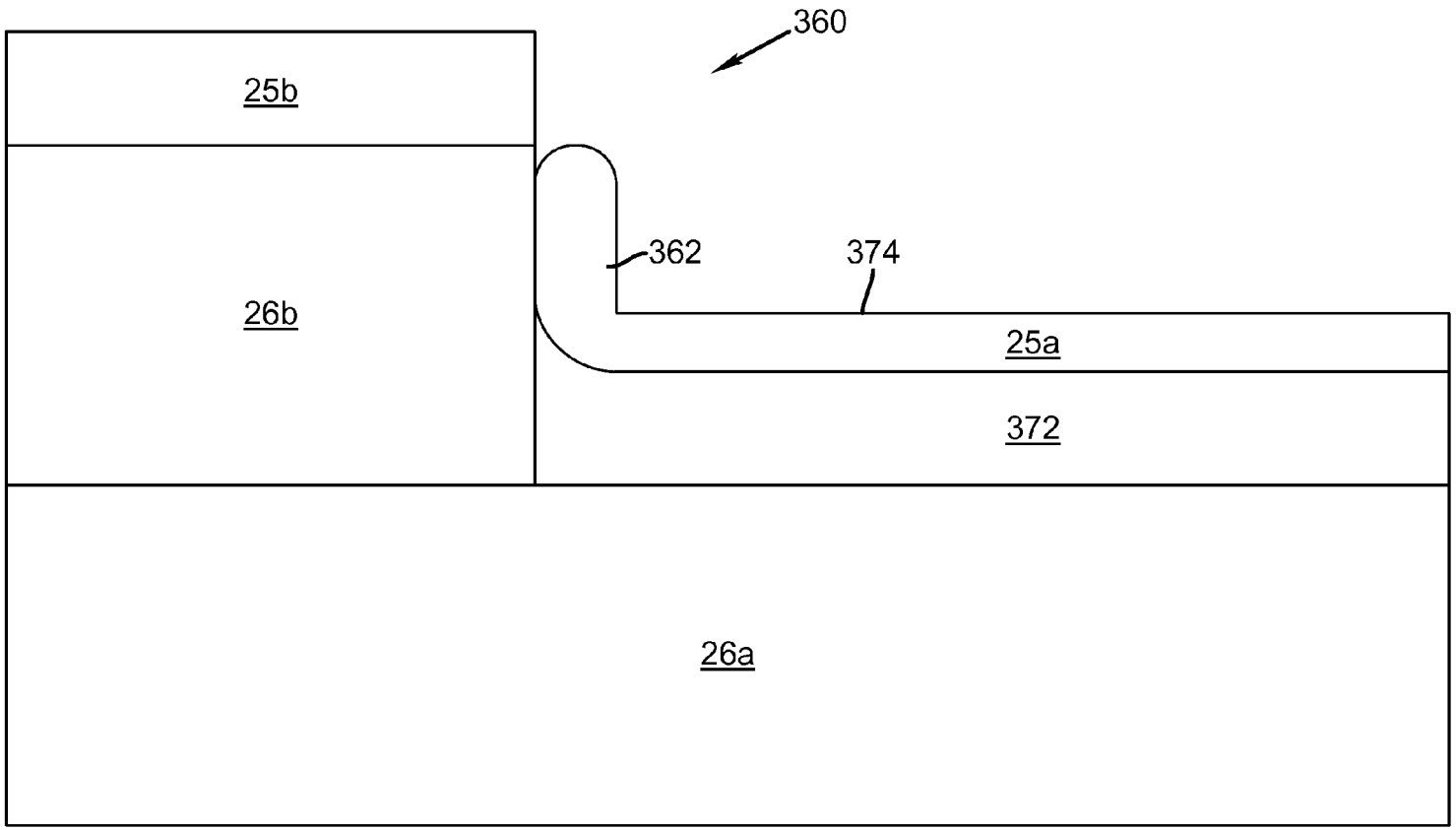
FIG. 21 shows an embodiment of an edge concealment toner pattern.

In a second embodiment, shown in FIG. 21, an edge concealment toner pattern 360 is applied in separate layers as can be applied by passing first receiver past print engine 22 more than once. For example, a first layer 372 of a masking toner 362 can be applied using a toner that matches the color of first receiver 26*a* or second receiver 26*b*. Where this is done, a second layer 374 of image forming toner can be applied in one or more additional layers formed over the first layer 372. For example, where first receiver 26*a* and second receiver 26*b* are white paper type receivers first layer 372 could be formed from a white toner, such as would be obtained with toner particles containing high dielectric constant materials such as TiO2, BaTiO3, or SrTiO3 while second layer 374 having first toner image 25*a* can be applied with an imaging pattern.

Figure 22:
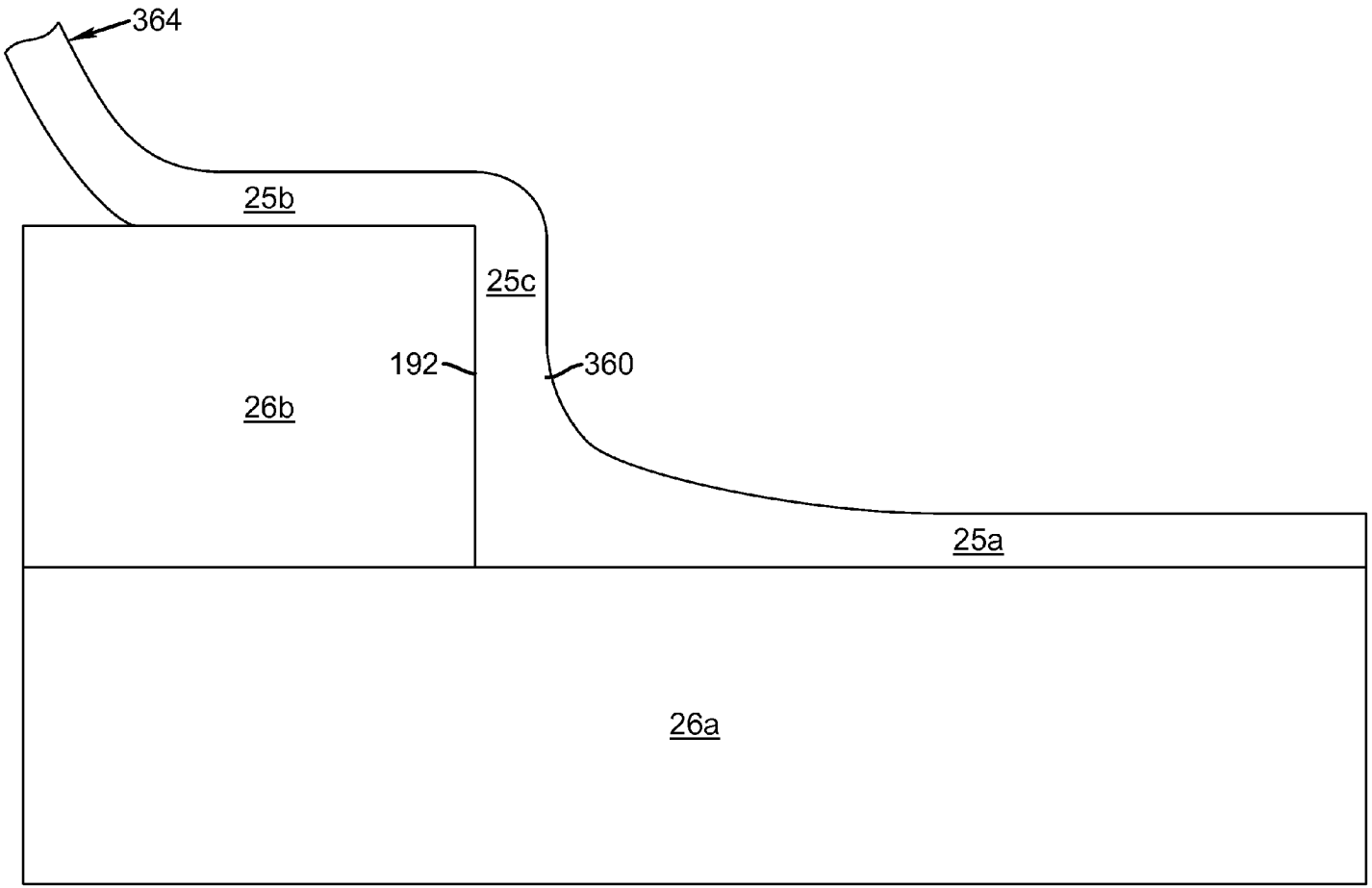
FIG. 22 shows a compliant roller used to apply toner to second edge in the formation of an edge concealment toner pattern.

In other embodiments, a portion of the edge concealment toner pattern 360 can be provided on second edge 192 of second receiver 26*b* during printing. For example, in the embodiment that is illustrated in FIG. 22 toner 24 forming part of edge concealment toner pattern 360 is recorded on second edge 192 as a part of a process of printing on an overlapped first receiver 26*a* and second receiver 26*b*. In this regard, it will be appreciated that a transfer subsystem 50 of print engine 22 typically uses a roller or belt surface to press first toner image 25*a* onto first receiver 26*a* and to press second toner image 25*b* onto second receiver 26*b*.

Figure 23:
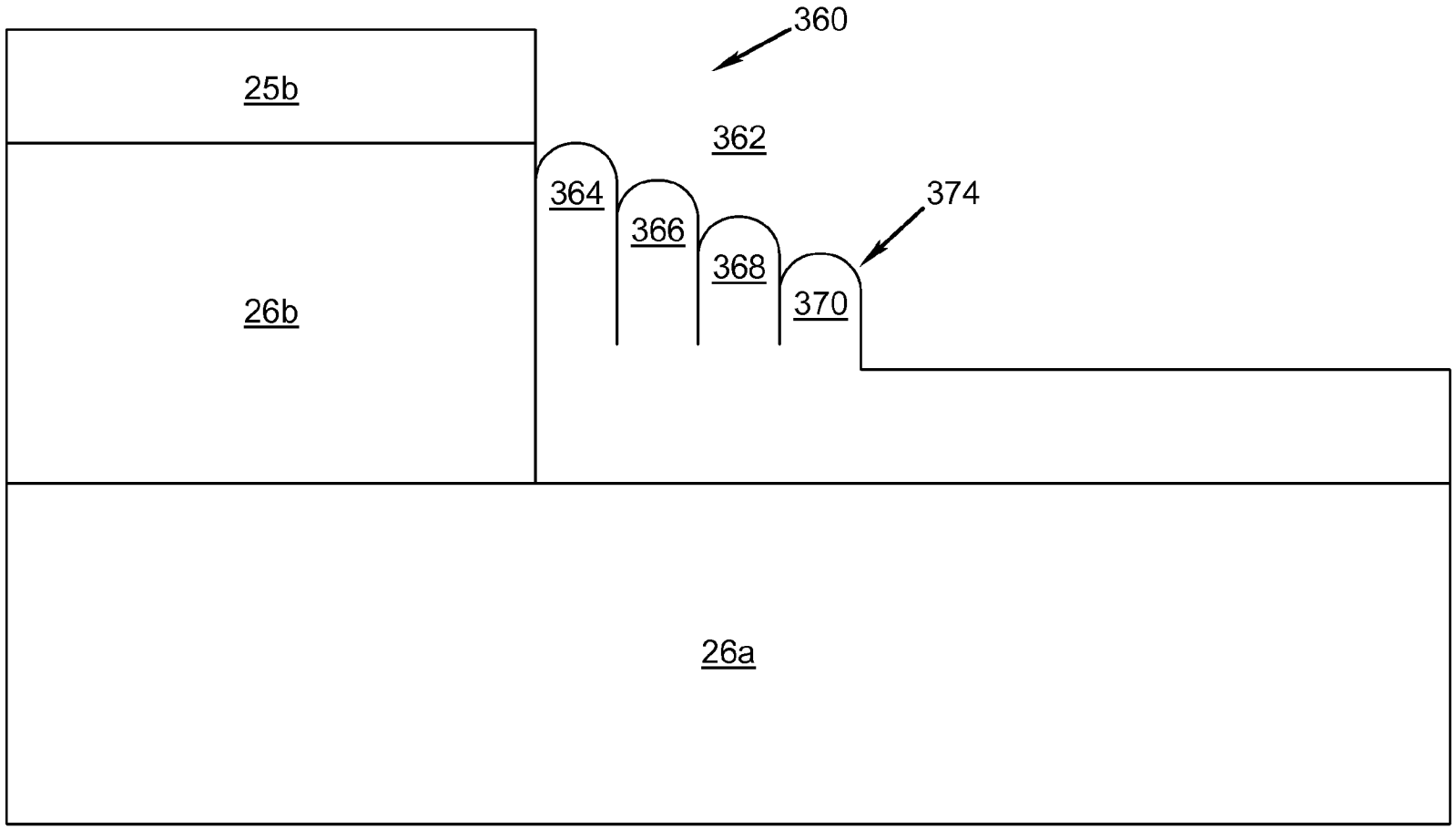
FIG. 23 shows another embodiment of an edge concealment toner pattern.

Because second edge 192 is perpendicular to first side 182 of first receiver 26*a*, such a transfer system 50 can be made to apply first toner image 25*a* and second toner image 25*b* using a compliant surface 364. As is illustrated in FIG. 23, used the compliant nature of compliant surface 366 can be used to manage the abrupt change in the thickness of the combination print 200 caused by second edge 192 while ensuring that toner 24 is transferred to first receiver 26*a*.

This can be achieved by forming first toner image 25*a* or second toner image 25*b* using a compliant surface 366 in transfer subsystem 50, as is known in the literature, and then transferring a portion of edge concealment toner pattern 360 from a portion of the compliant surface 366 that conforms to accommodate second edge 192. Compliant surface 366 will be able to conform to the shape of second edge 192 sufficiently so as to allow transfer of an edge toner image 26*c* to occur. Specifically, it will be observed from FIG. 22 that during the transition from applying toner to form first toner image 25*a*, to recording second toner image 25*b*, there is a portion 368 of compliant transfer surface 366 that is in contact with second edge 192. To the extent that an intermediate toner image is provided on portion 368, such intermediate toner image 26*c* can be applied to second edge 192 to form at least part of edge concealment toner pattern 360.

It will be appreciated however that while in some cases the use of an edge concealment toner pattern 360 in the manner shown in FIG. 22 such an edge can a masking toner of this type can sufficiently conceal second edge 192 can produce an aesthetically pleasing combination print 200, this type of edge concealment toner pattern 360 itself can compose an artifact when viewed from second viewing position 302. This is because the surface area of a projection of toner at first end includes both the top and sides of such a toner stack height which has an appearance that will be generally uniform along the extent of the projection, this creates a pixilation or graininess in edge concealment toner pattern 360 that is inconsistent with the pixilation or graininess of the remaining portions of the image formed on combination print 200.

Accordingly, in certain embodiments, the extent of the pixilation or graininess may itself require mitigation, and in such embodiments of edge concealment toner pattern 360 can be defined by printer controller 82 to limit the extent to which any individual toner stack forming a part of edge concealment toner pattern 360 can deviate from an adjacent stack can be minimized such that there is a gradation of toner stack heights in the first toner image as is illustrated in FIG. 22.

As is shown in, in FIG. 22, by the use of an edge concealment toner pattern 360 having a gradation of toner stack heights in successive toner piles 364, 366, 368 and 370 can help to address this problem by creating a condition where the amount of surface area of any one of toner piles 364, 366, 368 and 370 exposed a viewer can be maintained at a level that is comparable to the visible portion of a conventionally arranged toner pile.

As is also shown in FIG. 22, this creates a tapering or sloping of the toner stack heights at second edge 192 that helps to limit the visual impact of artifacts created by second edge 192 as well as controlling graininess and undue pixilation, while also advantageously forming a sloped surface proximate to second edge 192 that can form or be used to form a portion of a toner edge shield 232 described previously.

In yet another embodiment of edge concealment masking toner 360 can use mask second edge 192 using a gradient of clear toner with mixed with an amount of pigmented toner to create an image density that can obscure second edge. Here, the clear toner would elevate the at least some of the pigmented toner so as to allow the pigmented toner to gradually decrease in offset from the underlying receiver sheet, thereby reducing the edge appearance of second edge 192.

This approach would be particularly useful where the image content of the first toner image 26*a* has a high optical density proximate to second edge 192. Such mixing can occur as a product of planned mixing of toners, or it can occur during the development or fusing processes.

In still other embodiments, the edge concealment toner pattern 360 comprises clear toner patterns that are shaped to direct light in ways that minimize the extent to which light travels to second edge or the extent to which light that is reflected by second edge 192 is apparent to a viewer. In one example of this type of embodiment, the edge concealment toner pattern 360 includes light transmissive toner such as clear toner that is shaped to direct light that is incident on combination print 200 away from second edge 192 and onto first receiver 26*a*. Techniques for forming optical elements that can be used for such purposes are described in commonly assigned U.S. Pat. Pub. No. 2009/0016757 entitled Printing of Optical Elements by Electrophotography, filed by Priebe et al. on or about Jul. 13, 2008, which is incorporated herein by reference.

Figure 24:
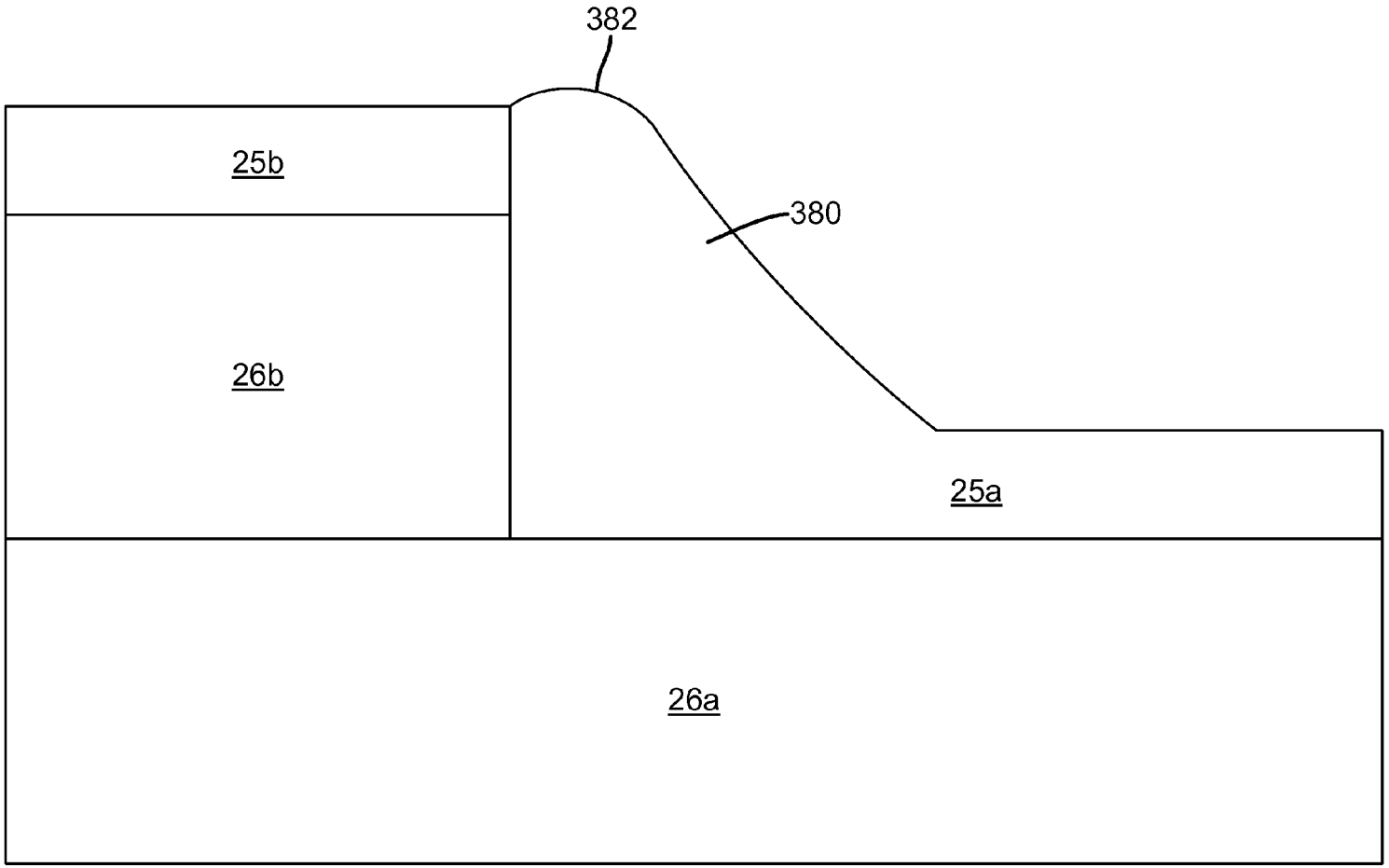
FIG. 24 shows an embodiment of an edge concealment toner pattern.

In another embodiment of this type, the edge concealment toner pattern 360 is shaped to reduce the visual impact of image artifacts created by the appearance of the second edge 192 by directing light that is reflected from the first print proximate to the second edge to a viewing surface having a height that is above the thickness of the second edge of the receiver. For example, in the embodiment shown in FIG. 24, a lens 380 is formed in a clear toner pattern 382 that focuses light that is incident a on a clear layer of toner toward first receiver 26*a* and away from second edge 192.

Figure 25:
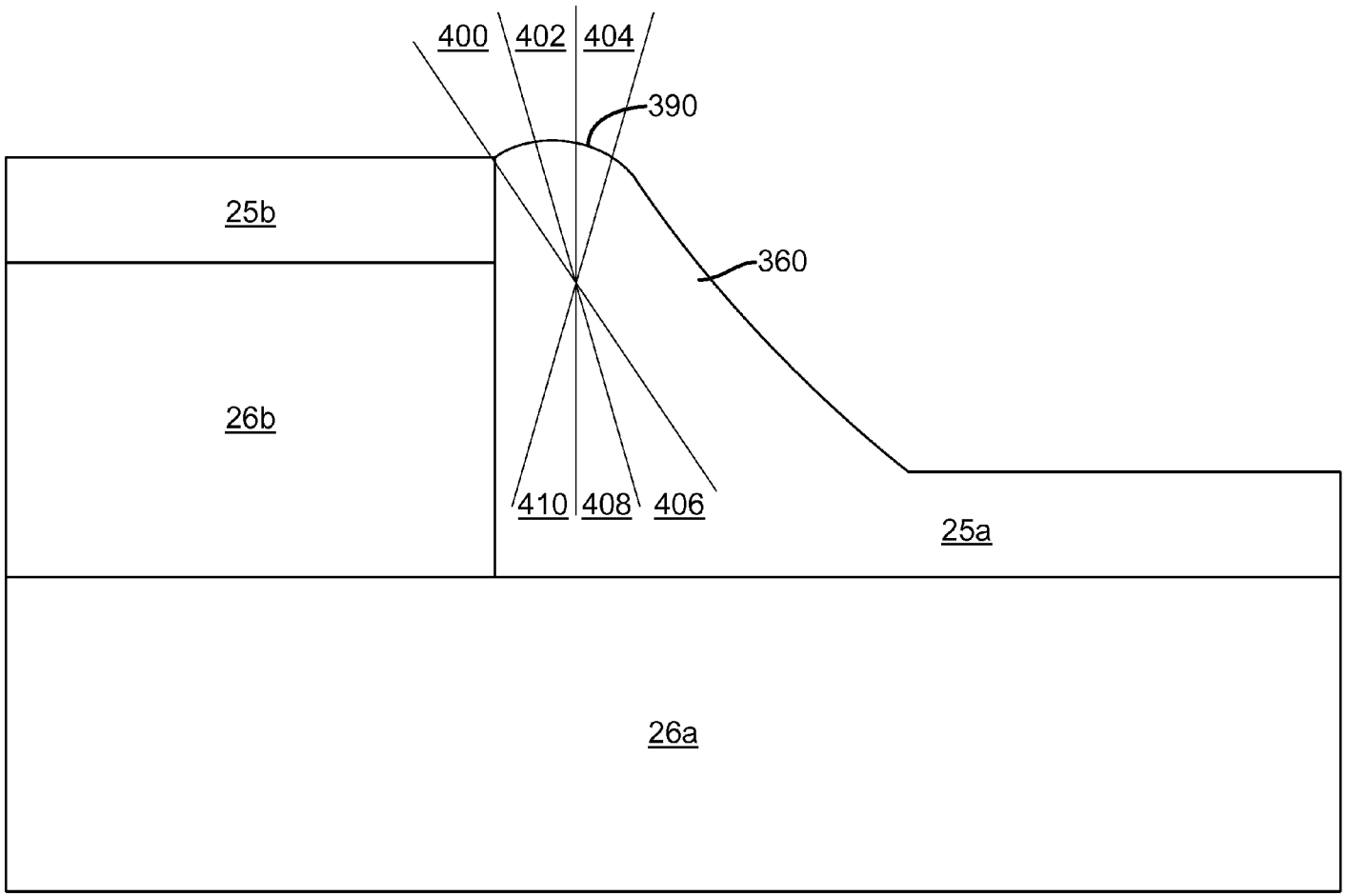
FIG. 25 shows another embodiment of an edge concealment toner pattern.

In a similar embodiment illustrated in FIG. 25, the edge concealment toner pattern 360 includes clear toner 24 applied to form an optical element 390 to diffuse light reflecting from first toner image 25*a* such that the diffused light from the first toner image 25*a* is presented across at least a part the second range of viewing positions 303 which the second edge could otherwise be seen.

As can also be observed in this embodiment optical element 390 is further used to help to address image discontinuities created by the overlap of second edge 192 relative to first edge 190 in that optical element 390 can be positioned to provide image content from different positions of first toner image 25*a* as a viewer moves between different viewing fields of view. Specifically, in this example, as a viewer moves between viewing areas 400, 402 and 404, the viewer will be able to observer image content from slightly different portions of first toner image 25*a*, shown here as areas 406, 408 and 410 respectively. In the event that a viewer shifts position from a first viewing position within a first field of view 400 relative to combination print 200 to a second viewing position within a second field 410 relative to combination print 200 the viewer will observe different content at optical element 390 that shifts from content presented in area 406 of first toner image 25*a* to image content presented in area 408.

In this regard, optical element 390 can, for example, comprise a lenticular lens with image content recorded relative to lens in first toner image 25*a* in a manner that is adapted to provide an angularly changing display that minimizes any discontinuities created by second edge 192. Techniques for forming such image content are well known in the art of making lenticular motion, depth enhanced and as well as other types of auto stereoscopic displays. In similar respect, edge concealment toner pattern 360 can incorporate barrier image techniques as are well known in the art to provide an angularly changing image.

In still another, embodiment, edge concealment toner pattern 360 is shaped to scatter or diffuse light that has been reflected by the second edge with light that has been reflected by the first receiver. This can be done by shaping an clear or non-clear toner to form structures such as triangular prisms, lenses, mixtures of concave and convex lens patterns or shapes or surface patterns that will cause variations it the direction of a light passing through the surface pattern. Similarly, under fused or partially fused toner can form internal structures that diffuse or scatter light and can be selectively formed at second edge 192 by selection of toner 24, toner image 25*a* and fusing technique as known in the art.

In yet another embodiment edge concealment toner pattern 360 can reduce the visual impact of image discontinuities created at second edge 192 by forming a surface having a pattern of toner 24 is fused to a low gloss level, i.e. fused to a gloss level of less than approximately 15 as measured using a G-20 gloss meter. This allows scattered light to be diffuse rather than specular, thereby softening the appearance of second edge 192. This can be accomplished using known means such as casting the first toner image 25*a* against a textured ferrotyping member, using one or more toner having glass transition temperatures that exceed 60 degrees Celsius or using one or more toners 24 having high rheological properties.

In still another embodiment of this type, the edge concealment toner pattern 360 includes providing a clear toner 24 having light scattering material or diffusing material therein to scatter or diffuse light that has been reflected by the second edge 192. Examples of such light scattering or diffusing materials include, for example, high dielectric constant materials including but not limited to $TiO_2$ and $SrTiO_3$ and $BaTi0_3$.

Figure 26:
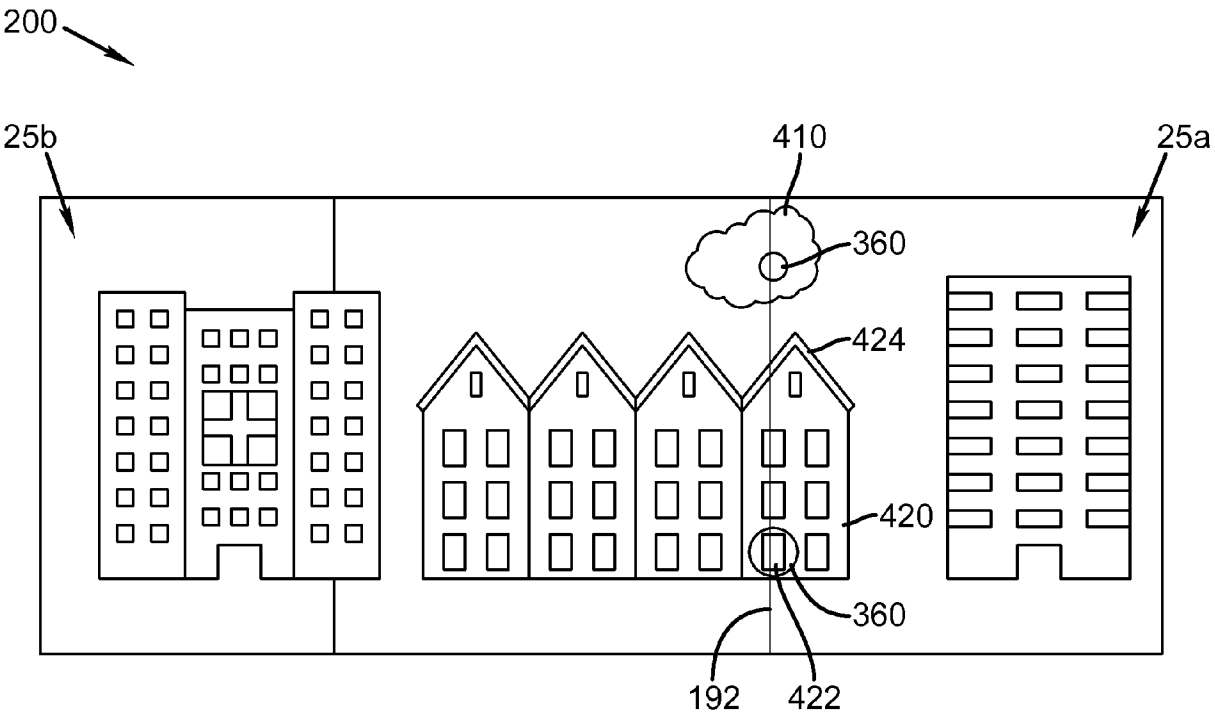
FIG. 26 shows still another embodiment of an edge concealment toner pattern.

In other embodiments, the edge concealment toner pattern 360 is formed in part by modification of image 140 formed in part by first toner pattern 25*a* and in part by second toner pattern 25*b*. FIG. 26 illustrates one example of such an embodiment of a combination print 200 having an edge concealment toner pattern 360 forming patterns such as patterns such as variations in density across cloud 420 that reduce the visual impact of image artifacts created by the overlapping second edge 192 to create patterns that are generally more easily detectable than the artifacts created by second edge 192 making the artifacts created by second edge 192 less likely to be noticed. In other embodiments of this type, edge concealment toner pattern 360 forms abrupt changes in the apparent texture, gloss, surface pattern, color, tone or hue in portions of first receiver 26*a* or second receiver 26*b* that are proximate to second edge 192 to create features that are more distracting.

As is further illustrated in FIG. 26, edge concealment toner pattern 360 can include coordinated patterns in both first toner image 25*a* and second toner image 25*b* including patterns formed variations in the apparent thickness, texture, surface pattern, gloss, color, tone or hue of the images and/or toner layers that are arranged both sides of or across second edge 192 and that appear to or that do extend across second edge 192. For example structural lines along edges of windows 422 and roof 426 of house 420 can be enhanced with patterns 430 that emphasize these features so as to focus the viewer's attention on the horizontal components of these structural lines. For example, edge concealment toner pattern 360 can comprise a glossing of windows 424 that is uniform across second edge 192 or as illustrated enhancing the contrast within cloud 410.

In yet another embodiment, edge concealment toner pattern 360 can include variations in the apparent thickness, texture, gloss, color, tone or hue, image density that are added to the image to appear to or to actually extend across the second edge include at least one of varied patterns of stripes, spots, shapes, or objects across the edge making the extent of the edge difficult detect. In one example of such an embodiment, edge concealment toner pattern 360 can be formed from a first toner image 25*a* and a second toner image 25*b* that have patterns of thickness, texture, gloss, color, tone or hue, image, contrast or color patterns density that extend across second edge that are mapped to detected edges, colors, shapes or other automatically detectable image content in the determined image. Preferably, such patterns are mapped to objects that are formed in part in first toner image 25*a* and in the second toner image 25*b*, as shown in the window glossing example discussed with reference to FIG. 26.

Such content mapped patterns can help to focus the attention of the viewer away from artifacts created by second edge 192.

It will further be appreciated that the above described features of toner edge shield 232 can be incorporated into edge concealment toner pattern 360 and similarly that edge concealment toner pattern 360 can be incorporated in edge shield 323.

What is claimed is:

1. A printer for forming a durable combination of printed receivers, the printer comprising:

a print engine cooperating with a receiver transport system to form a first toner image on a first side of a first receiver including toner in an overlap area and toner forming a toner shield, a second toner image on a first side of a second receiver;

an overlap positioning system cooperating with the receiver transport system to allow the first receiver to be overlapped with the second receiver;

a fuser that fuses the first receiver and the second receiver;

a printer controller cooperating with the print engine, receiver transport system, overlap positioning system, and fuser to cause a first toner image to be formed on the first side of the first receiver with toner at least in an overlap area proximate to a first edge of the first receiver; to overlap the first edge of the first receiver with a second edge of the second receiver having a second thickness at a second end and to fuse the overlapped first receiver and second receiver to cause the first toner image to bond to the first receiver, to cause the second toner image to bond to the second receiver, and to cause the toner in the overlap area to bond the first receiver to the second receiver; wherein the first toner image includes an edge concealment toner pattern positioned confronting the second edge with the edge concealment toner pattern having toner that reduces the visual impact of image artifacts created by the overlapping second edge.

2. The printer of claim 1, wherein the printer is capable of printing image elements having an equivalent appearance using different combinations of toner having different thicknesses and wherein the first toner image proximate the second edge is printed using combinations of toner that have greater thickness than other combinations of toner that can alternatively be used to form the portion of the first toner image proximate to the second edge.

3. The printer of claim 1, wherein the edge concealment toner pattern includes light transmissive toner that is shaped to direct light away from the second edge and onto the first print.

4. The printer of claim 1, wherein the edge concealment toner pattern is shaped to mask the appearance of the second edge by directing light that is reflected from the first print proximate to the second edge to a viewing surface having a height that is above the thickness of the second edge of the receiver.

5. The printer of claim 1, wherein the edge concealment toner pattern includes clear toner applied to form a lens to focus light reflecting from the first receiver such that the focused light is directed from the second edge onto the first surface.

6. The printer of claim 1, wherein the edge concealment toner pattern is shaped to scatter or diffuse light that has been reflected by the second edge.

7. The printer of claim 1, wherein the edge concealment toner pattern includes toner having light scattering material or light diffusing material therein to scatter or diffuse light that has been reflected by the second edge.

8. The printer of claim 1, wherein the edge concealment toner pattern has a pattern of colored marking toners applied to the first surface to project from the first surface to an extent that is sufficient to mask the appearance of the second edge.

9. The printer of claim 8, wherein the edge concealment toner pattern is formed in part by modification of an image formed on the second receiver and on the non-overlapped portion of the first receiver to provide contrast or color patterns that reduce the visual impact of image artifacts caused by the second edge.

10. The printer of claim 1, wherein the edge concealment toner pattern takes the form of changes in the apparent texture, gloss, surface pattern, color, tone or hue in portions of the first receiver or second receiver that are proximate to the second edge.

11. The printer of claim 1, wherein the edge concealment toner pattern and the second toner pattern include variations in the apparent thickness, texture, gloss, color, tone or hue that are arranged on both sides or across the second edge that appear to or that do extend across the second edge.

12. The printer of claim 1, wherein the edge concealment toner pattern and the second toner pattern include variations in the apparent thickness, texture, gloss, color, tone, hue, or image density that are added to the image to appear to extend across the edge including at least one of varied patterns of stripes, spots, shapes, or objects across the second edge making the extent of the edge difficult detect.

13. The method of claim 1, wherein the second receiver has toner applied to the second edge to partially mask the second edge.

14. The printer of claim 1, wherein a conformal roller is used to apply toner to the first receiver, second receiver and second edge.

15. The printer of claim 14, wherein the edge concealment toner pattern takes the form of changes in the apparent texture, gloss, surface texture, color, tone or hue in portions of the first receiver or second receiver that are proximate to the second edge.

16. The printer of claim 14, wherein the edge concealment toner pattern and the second toner pattern include variations in the apparent thickness, texture, gloss, color, tone or hue that are arranged across the second edge to appear to extend across the second edge to reduce the visual impact of the image artifacts created by the second edge.

17. The printer of claim 14, wherein the edge concealment toner pattern and the second toner pattern include variations in the apparent thickness, texture, gloss, color, tone or hue, image density that are added to the image to appear to extend across the second edge to minimize the appearance of the edge including at least one of varied patterns of stripes, spots, shapes, or objects across the edge making the extent of the edge difficult detect.

18. The printer of claim 14, wherein the edge concealment toner pattern forms.

19. The printer of claim 14, wherein the edge concealment toner pattern forms a toner image that has a pattern of thicknesses, texture, gloss, surface pattern, color, tone or hue, image density that extend across second edge and that are added to the determined image and that are mapped to detected edges, colors, shapes or other automatically detectable image content in the determined image.

20. The printer of claim 14, wherein the first toner pattern further comprises a clear toner layer forming a lens or barrier with image content recorded relative to the lens in first toner image in a manner that provides an angularly changing display of image content to reduce the visual impact of image artifacts created by the overlap of the second edge.

21. The printer of claim 20, wherein the first toner image is modified to provide image content that is determined to provide an angularly changing display changing display of image content at using lens or barrier to reduce the visual impact of image artifacts created by the overlap of the second edge.

22. A printer comprising:

a source of a print order including information from which an image and a receiver length for printing the image can be determined;

a print engine cooperating with a receiver transport system to form a first toner image on a first side of a first receiver and a second toner image on a first side of a second receiver;

an overlap positioning system cooperating with the receiver transport system to allow a first receiver to be overlapped with a second receiver;

a fuser that fuses the toner in the first toner image to the first receiver and toner in the second toner image to the second receiver; and a printer controller cooperating with the source of the print order, the print engine, receiver transport system, overlap positioning system and fuser to determine an image to be printed and an receiver length on which the image is to be printed; said printer controller further identifying overlapped arrangement of at least a first receiver and a second receiver that forms the determined receiver length and establishing a first toner pattern to form a first portion of the determined image on a first side of the first receiver and a second toner pattern to form a second portion of the determined image on a first side of the second receiver positioned so that the determined image is formed when the first receiver is overlapped by the second receiver to form the identified arrangement; to cause toner to be applied to the first side of the first receiver and to the first side of the second receiver according to the second toner pattern; to cause the overlap positioning system and receiver transport system to cooperate to cause a portion of the first receiver to be overlapped by a portion of the second receiver to form the identified arrangement; and, to cause the fuser to fuse the overlapped first receiver and second receiver;

wherein the printer controller causes wherein the first toner pattern to provides toner on an overlap area of the first receiver such that fusing the overlapped first receiver and second receiver causes the toner in the overlapped portion to bind the first receiver to the second receiver, and wherein the printer controller causes the first toner pattern to provide an edge concealment toner pattern having a first end confronting the second edge of the second receiver with said edge concealing toner pattern introducing variations that reduce the visual impact of image artifacts created by the overlap of the second edge over the first receiver.

23. The printer of claim 22, wherein the edge concealment toner pattern is shaped to scatter or diffuse light that has been reflected by the second edge with light that has been reflected by the first receiver.

24. The printer of claim 22, wherein the edge concealment toner pattern includes toner having light scattering or light diffusing material to scatter or diffuse light that has been reflected by the second edge.

* * * * *